US010420450B2

(12) United States Patent
Engesser et al.

(10) Patent No.: US 10,420,450 B2
(45) Date of Patent: Sep. 24, 2019

(54) CLEANING APPARATUS INCLUDING CONVEYING DEVICE AND CONTROL MEANS

(71) Applicant: MEIKO Maschinenbau GmbH & Co. KG, Offenburg (DE)

(72) Inventors: Klaus Engesser, Freiburg (DE); Regina Höschele, Offenburg (DE); Thomas Loos, Hohberg (DE); Johann Wagner, Lahr (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 234 days.

(21) Appl. No.: 15/118,418

(22) PCT Filed: Feb. 16, 2015

(86) PCT No.: PCT/EP2015/053210

§ 371 (c)(1),
(2) Date: Aug. 11, 2016

(87) PCT Pub. No.: WO2015/121469

PCT Pub. Date: Aug. 20, 2015

(65) Prior Publication Data

US 2017/0172371 A1 Jun. 22, 2017

(30) Foreign Application Priority Data

Feb. 17, 2014 (DE) ..... 10 2014 202 818

(51) Int. Cl.
*A47L 15/24* (2006.01)
*A47L 15/00* (2006.01)
(Continued)

(52) U.S. Cl.
CPC ..... *A47L 15/241* (2013.01); *A47L 15/0005* (2013.01); *A47L 15/0007* (2013.01);
(Continued)

(58) Field of Classification Search
None
See application file for complete search history.

(56) References Cited

U.S. PATENT DOCUMENTS 6,530,996 B2 3/2003 Värpiö
7,884,498 B2 2/2011 Ecker et al.
(Continued)

FOREIGN PATENT DOCUMENTS

DE 100 48 086 A1 4/2002
DE 10048086 A1 * 4/2002 ..... A47L 15/4295
(Continued)

OTHER PUBLICATIONS

International Search Report and Written Opinion issued in related International Patent Application No. PCT/EP2015/053210, dated Apr. 10, 2015.
(Continued)

*Primary Examiner* — Rita P Adhlakha
(74) *Attorney, Agent, or Firm* — Foley & Lardner LLP

(57) ABSTRACT

A cleaning apparatus for cleaning articles to be cleaned includes at least one cleaning chamber; at least one conveying device configured to convey the articles to be cleaned in a conveying direction through the cleaning chamber, the at least one conveying device comprising a plurality of tracks arranged side by side; at least one nozzle system configured to act upon the articles to be cleaned with at least one cleaning fluid; at least one sensor configured to detect a loading of the conveying device with articles to be cleaned; and at least one control means programmed to select at least one operating mode of the cleaning apparatus corresponding to the loading of the conveying device detected by the sensor, and to propose the selected operating mode to a user of the cleaning apparatus by providing a visual indicator on one or several tracks of the conveying device.

20 Claims, 4 Drawing Sheets

(51) Int. Cl.
*A47L 15/42* (2006.01)
*A47L 15/46* (2006.01)

(52) U.S. Cl.
CPC ..... *A47L 15/0047* (2013.01); *A47L 15/0076* (2013.01); *A47L 15/245* (2013.01); *A47L 15/248* (2013.01); *A47L 15/4282* (2013.01); *A47L 15/46* (2013.01); *A47L 2301/08* (2013.01); *A47L 2401/04* (2013.01); *A47L 2401/28* (2013.01); *A47L 2501/20* (2013.01); *A47L 2501/24* (2013.01); *A47L 2501/26* (2013.01); *A47L 2501/30* (2013.01); *A47L 2501/36* (2013.01)

(56) References Cited

U.S. PATENT DOCUMENTS

| | | | |
|---|---|---|---|
| 8,307,839 | B2 | 11/2012 | Peukert et al. |
| 8,746,262 | B2 | 6/2014 | Disch et al. |
| 2002/0020435 | A1* | 2/2002 | Varpio ..... A47L 15/0021 134/18 |
| 2009/0120465 | A1 | 5/2009 | Peukert et al. |
| 2009/0151750 | A1 | 6/2009 | Ecker et al. |
| 2011/0023910 | A1 | 2/2011 | Dirschus |
| 2011/0139186 | A1 | 6/2011 | Disch et al. |
| 2011/0203616 | A1 | 8/2011 | Berner et al. |
| 2014/0096798 | A1 | 4/2014 | Gaus et al. |
| 2015/0101639 | A1 | 4/2015 | Heppner |

FOREIGN PATENT DOCUMENTS

| | | | |
|---|---|---|---|
| DE | 10 2004 046 758 | A1 | 4/2006 |
| DE | 10 2007 053 381 | B3 | 4/2009 |
| DE | 10 2008 037 344 | A1 | 2/2010 |
| DE | 10 2008 057 178 | A1 | 5/2010 |
| DE | 10 2009 035 668 | A1 | 2/2011 |
| DE | 10 2011 077 660 | A1 | 12/2012 |
| DE | 10 2012 211 442 | A1 | 1/2014 |
| EP | 1 704 809 | A2 | 9/2006 |
| EP | 2 039 280 | A2 | 3/2009 |
| EP | 2 510 863 | A1 | 10/2012 |
| WO | WO 2009/114346 | A1 | 9/2009 |

OTHER PUBLICATIONS

International Preliminary Report on Patentability issued in related International Patent Application No. PCT/EP2015/053210, dated Jan. 22, 2016.

English Translation of the International Preliminary Report on Patentability issued in related International Patent Application No. PCT/EP2015/053210, dated Aug. 18, 2016.

* cited by examiner

CLEANING APPARATUS INCLUDING CONVEYING DEVICE AND CONTROL MEANS

CROSS-REFERENCE TO RELATED APPLICATIONS

This application is the National Phase of International Patent Application No. PCT/EP2015/053210, filed Feb. 16, 2015, which claims priority from German Patent Application No. 10 2014 202 818.3, filed Feb. 17, 2014. The contents of these applications are incorporated herein by reference in their entirety.

SCOPE OF THE INVENTION

The invention relates to a cleaning apparatus and to a method for cleaning articles to be cleaned. Said cleaning apparatus can be, in particular, a tunnel dishwashing machine, also known as a conveyor ware washer. The cleaning apparatus can be provided in particular for industrial use, such as for example in devices for communal catering such as in particular works canteens, canteens in schools, public authorities, hospitals or care facilities. The cleaning apparatus and the method can be used in particular to clean articles to be cleaned in the form of wash ware which is used directly or indirectly for preparing, keeping or administering meals and drinks. In particular, this can be crockery and/or serving trays. Other areas of application of the present invention are also fundamentally possible.

PRIOR ART

A plurality of cleaning apparatuses is known from the prior art. Without restricting further possible developments of the present invention, reference is made below in this case in particular to dishwashing machines. Along with single-chamber dishwashing machines, so-called tunnel dishwashing machines are also known where the articles to be cleaned are conveyed by means of a conveying device, for example by means of a conveyor belt, through one or several cleaning chambers. Tunnel dishwashing machines are described, for example, in DE 10 2004 046 758 A1, DE 10 2007 053 381 B3, DE 10 2009 035 668 A1 and DE 10 2011 077 660 A1.

These types of tunnel dishwashing machines have, for example, different treatment zones or cleaning zones for the articles to be cleaned. Thus, in many cases there is at least one wash zone for the main washing of the articles to be cleaned as well as at least one final rinse zone downstream. At least one fresh water rinse (FKSP) is provided as a rule in the final rinse zone. In the final fresh water rinse, fresh water, which as an option is heated and/or can be replaced by a rinse agent, in particular as a so-called rinse solution, is applied onto the articles to be cleaned by means of at least one nozzle. By way of the fresh water final rinse, last particles of dirt and residue from the washing liquid are rinsed, as a rule, from the articles to be cleaned in order to achieve a perfect rinse result.

One or several nozzles are used, as a rule, in the cleaning apparatus in order to apply the cleaning fluid, for example the rinse solution, onto the articles to be cleaned. Said nozzles are inserted in the majority of cases into at least one tube which is arranged transversely, for example orthogonally, with respect to the conveying direction in the fresh water rinse zone.

A certain number of nozzles is necessary, as a rule, in order to generate a desired spray pattern, depending, for example, on the width of a passage in the tunnel dishwashing machine. Said spray pattern should be sufficient to wet the articles to be cleaned over the entire passage width in as uniform a manner as possible. If too few nozzles are used, gaps are produced, for example, in the film of the cleaning fluid on the articles to be cleaned. In addition, as a rule, one nozzle requires a minimum amount of cleaning fluid per unit time to realize a good spray pattern. Falling below said amount leads, as a rule, to a bad spray pattern with the articles to be cleaned being wetted in a resultant non-uniform manner.

Conveyor ware washers which have sensor technology which detects whether articles to be cleaned are situated on the conveyor belt or not are known, in principle, from the prior art. Thus, operation of the conveyor ware washer is able to be adapted, for example, to a state of loading of the conveyor belt. DE 10 2008 037 344 A1, for example, discloses a conveyor ware washer which automatically reduces an amount of rinse liquid when it detects unoccupied belt portions. DE 10 2008 057 178 A1 discloses a dishwashing system with a conveyor ware washer which automatically modifies operating parameters when it detects unoccupied belt portions, for example lowers the conveying speed or switches into a different operating program.

Furthermore, DE 10 2012 211 442 A1 discloses a cleaning apparatus which comprises at least one final rinse nozzle system for acting upon the articles to be cleaned with at least one final rinse fluid. The final rinse nozzle system comprises at least two final rinse nozzle units which are arranged at different positions transversely with respect to the conveying direction. The final rinse nozzle units can be switched independently of one another in order to act upon the articles to be cleaned with the final rinse fluid at different positions independently of one another. Reference is made below in part to the contents of said document.

DE 10 2008 037 344 A1 describes a conveyor ware washer with a conveying device for conveying wash ware through a final rinse zone. A wash ware sensor device is provided to detect empty compartments. Furthermore, a control device is provided which is realized to adjust the amount of final rinse liquid supplied to the spray nozzles per unit time automatically in dependence on the detection of empty compartments.

DE 100 48 086 A1 discloses a method for detecting the loading status in a program-controlled dishwashing machine as well as a dishwashing machine for carrying out said method. Among other things, described here is that, proceeding from a scanned loading size, the type and/or the degree of soiling of the articles to be cleaned, a program control of the apparatus selects a suitable rinse program and actuates the same or displays to a user which program is advantageous to choose.

U.S. Pat. No. 6,530,996 B1 describes an automated rinsing device which, by means of suitable sensors, automatically detects rinse racks which enter into a rinse zone. A suitable rinse program is automatically selected by means of a control device, or a conveying device is stopped if a crockery rack is not followed directly by a new crockery rack.

In spite of the advantages achieved with the known apparatuses, in particular with regard to saving resources, there is further optimization potential, in particular in the case of industrial dishwashing machines. In particular, in this case, it must be considered that when the conveying device is incompletely occupied with articles to be cleaned, final rinse fluid is still sprayed unnecessarily in empty belt regions and, as a result, in particular fresh water is used.

Furthermore, where the operation of the dishwashing machine is automatically adapted to requirements, in many cases the effect can be that an operator or a user of the conveyor ware washer can lose control of the dishwashing machine. If, for example, during the operation of the conveyor ware washer there are hardly any articles to be cleaned and the conveyor ware washer automatically modifies the operating parameters, the operator loses dominance over the process, although the operator, as a rule, bears the responsibility for an economical and hygienic operation. If the low occupancy rates, however, only occur predictably in the short term, the operator, in practice, has no possibility to avoid the automatic changeovers. If during the operation of the conveyor ware washer there are hardly any articles to be cleaned and said articles to be cleaned, however, are placed onto the conveyor belt more or less randomly over the belt width, the maximum possible savings potential cannot be achieved.

OBJECT OF THE INVENTION

It is consequently an object of the present invention to provide a cleaning apparatus and a method for cleaning articles to be cleaned, both of which avoid the disadvantages of known apparatuses and methods in as extensive a manner as possible. In particular, a cleaning apparatus and a method are to be provided which enable the operation to be adapted to requirements so as to save on resources without an operator of the machine losing dominance over the cleaning process and without there being any risk of reducing the effect of the cleaning and of the sanitization.

DISCLOSURE OF THE INVENTION

Said object is achieved by a cleaning apparatus and a method for cleaning articles to be cleaned, with the features of the independent claims. Advantageous further developments of the invention, which are realizable individually or in arbitrary combination, are shown in the dependent claims.

The proposed method, in this case, is able to be carried out using a cleaning apparatus according to the invention. As an alternative to this or in addition to it, the cleaning apparatus is also able to be set up to carry out a method according to the invention. Accordingly, for possible developments of the method reference can be made to the description of the cleaning apparatus and vice versa. Other developments are, however, fundamentally possible.

It is pointed out that the expressions below "have", "encompass" and "include" can be understood as both exclusive and non-exclusive. Accordingly, the expression, for example, "A includes B" can be understood to mean that A, apart from B, comprises no further elements (exclusive meaning). As an alternative to this, the expression can also mean that A, along with B, comprises one or several further elements, for example the element C.

In a first aspect of the present invention, a cleaning apparatus is proposed for cleaning articles to be cleaned. A cleaning apparatus, in this case, is to be generally understood within the framework of the present invention as an apparatus where the articles to be cleaned are cleaned by means of at least one cleaning fluid in order to free said articles to be cleaned at least in part of adhering dirt or other contaminants. In addition, the cleaning apparatus can also exert a germicidal effect or even a disinfecting effect on the articles to be cleaned. Correspondingly, a method for cleaning articles to be cleaned, also called a cleaning method below, is to be understood as acting upon the articles to be cleaned with at least one cleaning fluid, for the purposes of removing adhering dirt at least in part from the articles to be cleaned. In addition, the cleaning method can also exert a germicidal effect or even a disinfecting effect on the articles to be cleaned. For possible developments of the cleaning apparatus, apart from the aspects according to the invention described in more detail below, reference can be made, for example, to the above-mentioned prior art, in particular DE 10 2012 211 442, the contents of which are hereby made a component part of the present description. Other developments, however, are also fundamentally possible.

Articles to be cleaned, in this case, can be generally understood as arbitrary items which can be subjected to cleaning or to a cleaning method. Without restricting further possible developments, in this case reference is made below to articles to be cleaned in the form of wash ware. Wash ware, in this case, is to include any objects which are provided for preparing, administering or storing meals and drinks. Crockery such as cups, plates, glasses, bowls or dishes can be named as examples hereof. In addition, pots, trays, cutlery, devices for keeping things warm or similar devices can be named.

The cleaning apparatus can be developed in particular as a tunnel dishwashing machine. A tunnel dishwashing machine, in this case, is to be understood as a dishwashing machine, that is a machine for cleaning wash ware in the form of crockery, which is set up in order to convey the wash ware through a cleaning chamber. In particular, in this case, this can be a conveyor ware washer and/or a rack conveyor ware washer, that is a dishwashing machine where the crockery is conveyed through the cleaning apparatus by means of a conveyor belt, for example a conveyor belt onto which the crockery is placed directly and/or onto which one or several racks are placed with the crockery to be cleaned. The tunnel dishwashing machine can be developed, in particular, for industrial use, for example in one or several of the abovementioned facilities for community care.

The cleaning apparatus includes at least one cleaning chamber and at least one conveying device which is set up to convey the articles to be cleaned in a conveying direction through the cleaning chamber. A cleaning chamber, in this case, is to be understood in general as a chamber in which the above-described cleaning operation of the articles to be cleaned is carried out completely or in part. In particular, the acting-upon with the cleaning fluid or with one of several cleaning fluids can be effected in a cleaning chamber. The chamber is preferably surrounded completely or in part by a housing. In particular, the cleaning chamber can be developed in a tunnel-like manner or can include part of a tunnel, for example with an inlet and an outlet, the articles to be cleaned being introduced into the cleaning chamber at the inlet and leaving the cleaning chamber at the outlet.

A conveying device is to be understood in general within the framework of the present invention as an arbitrary device which is set up to convey the articles to be cleaned in a conveying direction through the cleaning chamber. For example, said conveying device can be selected from a conveyor device with at least one conveyor belt and a roller conveying system with at least one conveying roller or a plurality of conveying rollers, for example one or several driven conveying rollers, by means of which, for example, the articles to be cleaned can be conveyed directly and/or one or several racks which receive the articles to be cleaned can be conveyed in the conveying direction through the cleaning chamber.

The cleaning apparatus additionally comprises at least one nozzle system for acting upon the articles to be cleaned with at least one cleaning fluid. For example, the nozzle system, as described in DE 10 2012 211 442 A1, can comprise at least one final rinse step nozzle system.

As an alternative to this or in addition to it, one or several further nozzle systems can be provided, by means of which the articles to be cleaned are able to be acted upon with one or several different cleaning fluids. The at least one cleaning fluid can fundamentally include, for example, at least one cleaning liquid, in particular at least one aqueous cleaning liquid, for example water, in the form of fresh water and/or with one or several additives, for example with one or several cleaning agent concentrates and/or one or several rinse agent concentrates and/or one or several disinfecting means. Other types of cleaning fluids can also be used in principle. Reference is made below as an example and without restricting further developments, in particular with regard to the solution according to the invention, to the final rinse nozzle system and to the final rinse fluid. However, it must be emphasized that, in principle, in addition to or as an alternative to the final rinse nozzle system, one or several other nozzle systems are also referred to and/or can be controlled according to the invention and/or that as an alternative to or in addition to the named final rinse fluid, other types of cleaning fluid can be used.

As stated above, the cleaning operation is carried out using at least one cleaning fluid. The final rinse fluid is an exemplary embodiment of a cleaning fluid. In addition to the final rinse fluid further cleaning fluids can be used in the cleaning apparatus in order to wash the articles to be cleaned for example prior to acting upon them with the final rinse fluid and to rinse away coarse dirt particles. The final rinse fluid serves finally for the purpose of rinsing away adhering residues of preceding cleaning fluids with which the articles to be cleaned have been acted upon beforehand so that preferably no remains of cleaning fluids whatsoever still remain on the articles to be cleaned. The final rinse fluid, in a chain of being acted upon with several cleaning fluids, is consequently preferably the last cleaning fluid with which the articles to be cleaned are rinsed, preferably free of residues. For this purpose, the final rinse fluid can be, for example, an aqueous final rinse fluid, to which preferably one or several final rinse agents are admixed. A final rise agent is to be understood, in this case, in general as a liquid which improves the drying of the articles to be cleaned. The final rinse agent can include, for example, one or several tensides, for example non-ionic tensides which reduce the surface tension of the final rinse fluid, for example the surface tension of the water such that, for example, the final rinse fluid is able to drain away without forming droplets. As an alternative to this or in addition to it, the final rinse agent can include, for example, further substances, for example one or several organic acids such as, for example, citric acid and/or lactic acid, for example for complex formation with hardness-forming ions such as calcium ions or magnesium ions. Said one or several acids can also serve for neutralizing alkaline constituents. Furthermore, the final rinse agent can include one or several solvents, preservatives, solubilizers as well as, where applicable, one or several fragrances. The final rinse fluid can consequently be, in particular, an aqueous solution of a final rinse agent, it being possible for the final rinse agent to include one or several of the above-mentioned constituents, in particular one or several non-ionic tensides and/or one or several organic acids. As an alternative to this or in addition to it, the final rinse fluid can, however, also be just fresh water or can include fresh water. The final rinse fluid can, in particular, be tempered and can comprise a temperature, for example of 80° C.-100° C. and preferably of 85° C.-95° C. Said tempering can promote, for example, the above-described residue-free drying action, preferably without forming droplets on the articles to be cleaned.

A nozzle system is to be understood in general within the framework of the invention as a device which comprises one or several nozzles. A nozzle is to be understood in general as a device in which, for example by means of a line system and/or a pipe system, a fluid can be prepared such that said fluid is able to emerge through one or several openings in the nozzle. For example, a nozzle can itself include one or several openings. For example, the prepared fluid can emerge through said one or several openings under pressure such that an injecting operation and/or a spraying operation is effected where the fluid, for example the cleaning fluid and in this case in particular the final rinse fluid, is injected and/or sprayed onto the articles to be cleaned. A final rinse nozzle system is consequently to be understood, for example, as a nozzle system in terms of the above definition, through which final rinse fluid is able to be applied in drops, injected or sprayed onto the articles to be cleaned.

The cleaning apparatus additionally comprises at least one sensor for the articles to be cleaned which is set up in order to detect a loading of the conveying device with articles to be cleaned. A sensor for the articles to be cleaned is to be understood in general within the framework of the present invention as a device which is able to detect the presence of the articles to be cleaned and/or a position of the articles to be cleaned. Furthermore, the sensor for the articles to be cleaned can be set up to detect, alone or in combination with a control means which is described in more detail below, an incidence or frequency of the appearance of the articles to be cleaned, for example on certain tracks of the conveying device. Thus, for example, it can be detected in a certain track, in the case of the current loading and/or at the current conveying speed of the conveying device, how often the articles to be cleaned appear in the named track.

Thus, for example, the conveying device can be divided into two or more tracks. For example, one conveyor belt of the conveying device can be divided into two or more tracks. For example, two tracks, three tracks, four tracks, five tracks, six tracks or more tracks can be provided. The division can actually be effected, for example, by the conveying device comprising several segments and being divided structurally into several tracks, for example into belt segments, in particular into differently-colored belt segments, or purely virtually, by the conveying device, without the segments being structurally separated, being divided virtually into two or more segments. Thus, a dishwashing machine can comprise, for example, intrinsic belt segments which can be marked in different colors. The control means explained in more detail below can be set up, for example, to divide the conveying device virtually into several segments, preferably into segments which are arranged side by side and which move in the conveying direction in the same manner, for example belt segments. The division of the conveying device into tracks, in particular into virtual tracks, can be fixedly prescribed, but can also be variable. Thus, for example, depending on requirement, the conveying device is able to be divided, preferably virtually, into two tracks, into three tracks, into four tracks or into more tracks.

A track is to be understood therefore, in principle, as a portion or a segment of the conveying device transversely to the conveying direction, for example perpendicular to the conveying direction, which is to be regarded as a unit and the loading of which with articles to be cleaned is able to be detected. Thus, for example, at least one sensor for the articles to be cleaned is provided per track, which sensor detects articles to be cleaned on the track, for example at a certain point along a conveying path inside the cleaning apparatus. As an alternative to this or in addition to it, however, it is also possible to provide at least one sensor for the articles to be cleaned which registers several or all the tracks at the same time or sequentially and detects articles to be cleaned in the several or all of the tracks, for example at a certain point along a conveying path inside the conveying apparatus. The latter can be realized, for example, by means of a camera system, for example a camera system with image recognition.

The detecting of the articles to be cleaned can be effected, for example, by means of one or several of the following measuring principles: electrically, electro-mechanically, mechanically, inductively, by means of ultrasound, by means of infrared rays, optically, by means of at least one image recognition means, for example a camera system. Thus, the sensor for the articles to be cleaned can be selected in particular from the group consisting of: an electric sensor for the articles to be cleaned; a capacitive sensor for the articles to be cleaned; an inductive sensor for the articles to be cleaned; an electro-mechanical sensor for the articles to be cleaned; a mechanical sensor for the articles to be cleaned; an infrared sensor for the articles to be cleaned; an ultrasound sensor for the articles to be cleaned; an optical sensor for the articles to be cleaned and an imaging sensor. For example, the at least one sensor for the articles to be cleaned can comprise at least one detection zone which, for example, can be one-dimensional or two-dimensional and which preferably covers the entire width of the conveying device. In this way, for example, a presence of the articles to be cleaned in said detection zone can be detected in a one-dimensional or two-dimensional or, where applicable, even three-dimensional manner. For example, the conveying device, as stated above, can be divided into tracks, also to be designed as sectors, in a direction perpendicular to the conveying direction, it being detectable for example by means of the at least one sensor for the articles to be cleaned whether a respective sector is occupied with articles to be cleaned or not. The sectors can correspond, for example, to the above-described regions of the nozzle units, in particular to the final rinse nozzle units. Thus, the respective at least one nozzle unit, which is associated with one section, is able to be controlled, for example in a targeted manner, in this way.

The cleaning apparatus additionally comprises at least one control means and at least one displaying means. The control means is set up in order to select at least one operating mode of the cleaning apparatus, preferably precisely one operating mode of the cleaning apparatus, corresponding to the detected loading of the conveying device with the articles to be cleaned and to propose the selected operating mode by means of the displaying device to a user of the cleaning apparatus.

A control means is to be understood in general as an electronic device which is able to control and/or regulate one or several operating sequences of the cleaning apparatus. For example, the control means can be set up in terms of programming in order to carry out at least one cleaning program and/or a plurality of cleaning programs in the cleaning apparatus. As an alternative to this or in addition to it, the control means can be set up in order to influence at least one operating parameter of the cleaning apparatus, for example a conveying speed of the conveying device. For the purposes of influencing the at least one operating parameter and/or for the purposes of carrying out the at least one cleaning program, the control means can actuate, for example, one or several elements of the cleaning apparatus. In a particularly preferred manner, the control means can be set up to switch the nozzle units, for example the final rinse nozzle units. For this purpose, for example, one or several electronic connections can be provided between the control means and the nozzle units and/or one or several switching elements can be provided which can ensure the nozzle units are able to be switched independently (for example valves and/or pumps).

The control means can include, for example, at least one data processing device, for example at least one computer or microcontroller. The control means can additionally include at least one interface, for example an electronic interface and/or a man-machine interface such as, for example, an input/output device such as a display and/or a keyboard. The control means can have a centralized or a decentralized structure, for example. Thus, for example, several decentralized control means can also be provided, for example one control means per switching element and/or one control means per final rinse nozzle unit and/or one control means per sensor for the articles to be cleaned. Other developments are also conceivable.

The control means can be set up in particular to combine, where required, several nozzle units, for example several final rinse nozzle units, to form groups, the nozzle units in each case of one group being switched together. Other developments are also possible. The term "where required", in this case, as stated in more detail below, is to be understood as the control means detecting whether at that moment, in the region which is covered by the respective group of nozzle units and is acted upon with final rinse fluid, there is a requirement to be acted upon in such a manner, that is whether, for example, there are articles to be cleaned in said region or not.

The control means can additionally be connected to the display device, or the display device can be a constituent part, entirely or in part, of the control means. A display device is to be understood in this case, in principle, as an arbitrary device which is set up to communicate the proposal with reference to the selected operating mode to the operator of the cleaning apparatus and/or to operating personnel. The display device can include, for example, an arbitrary device which is set up to communicate one or several details to the user, the details being shown in at least one manner: as visual data; as acoustic data; as haptic data. Thus, the display device is able to be, for example, a visual display device or can include a visual display device, for example a display screen. As is stated below in more detail, the display device can, however, preferably include at least one illuminating device which communicates a proposal with regard to the tracks of the conveying device to be occupied to the user, for example by said tracks, in particular belt segments of a conveyor belt, being selectively illuminated. Other types of visual display device, however, are also usable as an alternative to this or in addition to it, for example LED displays, illuminated symbols or other types of visual display. An acoustic output in the form of a loudspeaker output can be provided, for example, as an acoustic display device, by the proposal being communicated to the user, for example by means of a loudspeaker output, for example by the user being given a recommendation with regard to the tracks of the conveying device to be occupied in an acoustic manner. A haptic output can be effected, for example, by means of a vibration or similar devices.

A proposal is to be understood in this case, in general, within the framework of the present invention as the control means being set up to make the user aware of the one operating mode, in particular an operating mode which leads one to expect an improved operation, for example greater efficiency, in relation to the current situation. The proposal, however, is not inevitably implemented, in particular it is not run inevitably automatically. It is preferred, however, as stated in more detail below, when the proposal is not implemented until it is confirmed by the user.

An operating mode is to be understood in this case in general as a certain manner of an operation of the cleaning apparatus. The operation can include, on the one hand, machine parameters or operating parameters of the cleaning apparatus, that is, for example, a conveying speed of the conveying device, a manner in which the articles to be cleaned are acted upon with cleaning fluid or also other operating parameters or combinations of operating parameters. As an alternative to this or in addition to it, the operation can, however, also include parameters which can be influenced by the user and cannot be influenced by the cleaning apparatus itself, for example loading the conveying device with articles to be cleaned. An operating mode, therefore, can be understood both as factors which can be influenced by the control means and which cannot be influenced by the control means and which can have an influence on the cleaning of the articles to be cleaned by the cleaning apparatus and/or on the efficiency of the operation. In particular, the operating mode can be selected from a cleaning program and from a loading of the conveying device with articles to be cleaned.

The control means can therefore be set up in particular to propose a certain selected program to the user and/or to propose a certain type of loading of the conveying device with articles to be cleaned to the user, for example occupancy of one or several selected tracks of the conveying device with articles to be cleaned. For example, the control means can provide a plurality of possible operating modes, for example in a data storage unit. On account of the current loading of the conveying device with articles to be cleaned which is registered by means of the sensor for the articles to be cleaned, the cleaning apparatus can select from said possible operating modes one or several operating modes which, with regard to certain predefined criteria, comprise the best characteristics from all the possible operating modes. If, for example, the control means ascertains by means of the sensor for the articles to be cleaned that the density of the occupancy of the conveying device with articles to be cleaned has a certain value which enables a reduction in the number of occupied tracks, the control means is thus able to recognize that an operating mode with a smaller number of occupied tracks would be possible. The control means can then propose to the user simply to occupy certain tracks with the smaller number of articles to be cleaned, for example by exclusively illuminating the tracks to be occupied by means of the display device. If the user accepts this proposal, the control means can be set up, for example, to actuate the nozzle system by means of the sensor for the articles to be cleaned in such a manner that purely those nozzle units of the nozzle system which are associated with the occupied tracks are actively engaged, whereas nozzle units which are associated with the non-occupied track are disengaged. Other developments of the proposal, however, are also possible. Thus the proposal, as an alternative to or in addition to a certain method of operation of the nozzle system, can also extend to a drying of the articles to be cleaned and/or to other treatment zones. In addition, as an alternative to this or in addition to it, the conveying device could also include different or individually actuatable drives for individual tracks. Thus, the proposal can also include, for example, that for one or several tracks a drive is disengaged or, for example, is put to a slower conveying speed. Generally speaking, it is then possible for the tracks to have different conveying speeds.

Nevertheless, the control means can be set up to perceive a safety function, for example to detect when the user, in spite of possible confirmation of the proposed operating mode, deviates, in turn, from the proposed operating mode. For example, the control means can be set up to detect, by means of the sensor for the articles to be cleaned, incorrect loading of the tracks. If, for example, tracks are occupied with articles to be cleaned which, according to the selected operating mode proposed, should not have been occupied with articles to be cleaned, the control means can detect this, for example by means of the sensor for the articles to be cleaned, and introduce corresponding measures. Said measures can consist, for example, in that the user is made aware of the deviation from the proposed operating mode, for example once again as a result of the at least one display device or as a result of at least one other display device, for example at least one warning lamp. As an alternative to this or in addition to it, the control means can also be set up, for example, to adapt the operation of the cleaning apparatus automatically to the deviation, for example by the nozzle system being automatically switched in such a manner that even articles to be cleaned which are arranged incorrectly on the tracks which are not to be occupied, are acted upon with cleaning fluid. Once the incorrectly occupied portion of the conveying device has been run through, it is then possible, for example, to revert once again to the proposed operating mode, for example by once again only those tracks which are correctly to be occupied with articles to be cleaned being acted upon with cleaning fluid. In this way, in spite of carrying out the proposed operating mode, cleaning and/or sanitizing the articles to be cleaned can be ensured even if the conveying device is incorrectly occupied by the user.

As stated above, the operating mode can comprise both operating parameters which can be influenced by the control means and operating parameters which cannot be influenced by the control means. Combinations are also possible. Thus, the selected operating mode can comprise, for example, at least one operating parameter, selected from the group consisting of: future occupancy of the conveying device with items to be cleaned, in particular utilization of one or several predefined tracks of the conveying device; conveying speed of the conveying device; a cleaning program; activation of one or several nozzles of the nozzle system; disengagement of one or several nozzles of the nozzle system. Other developments are also possible in principle.

As additionally stated above, the cleaning apparatus can preferably be set up in particular not to implement the selected operating mode until confirmation by the user. Thus, the control means can be set up to wait for confirmation of the proposed selected operating mode from the user and not to implement the selected operating mode until confirmation by the user. It can be ensured in this way that the user always maintains the dominance and control of the cleaning operation.

The user is able to confirm the proposed selected operating mode in different ways. In particular, the cleaning apparatus can be set up to detect confirmation by means of a predetermined or pre-determinable action of the user. For example, the user can simply follow the proposal and as a result confirm the proposal by implication, for example, by the user simply placing articles to be cleaned onto one or several predetermined tracks, corresponding to the proposal.

By means of the at least one sensor for the articles to be cleaned, the cleaning apparatus, in particular the control means, is then able to detect that the user is following the proposal and implement the proposal. As an alternative to this or in addition to it, the cleaning apparatus can also make possible at least one confirmation of the proposal by at least one control element, the control element being actuatable by the user to confirm the proposal.

Thus, the cleaning apparatus can additionally comprise, for example, at least one control element which is operable by the user, and the control means can be set up in order to await confirmation of the proposed selected operating mode by the user by means of the control element and not to implement the proposed operating mode until confirmation by the user. A control element is to be understood, in principle, as an arbitrary input device, by means of which the user is able to communicate an instruction or information to the cleaning apparatus, in particular to the control means, in particular confirmation and/or rejection of the proposed operating mode. For example, said control element can include at least one control element, selected from the group consisting of: a switch, in particular a membrane switch, a pressure switch, a sliding switch, a virtual switch on a display, a foot switch; a button, in particular a push button, a membrane button, a virtual button on a display; a lever, in particular a lever that is actuatable by the hand, foot or elbow. Other types of control elements are also known in principle and can be used as an alternative to these or in addition to them.

The control element can include, for example, a control element of the control means, for example of a machine control means, for example a keyboard and/or a touch screen. The control element, however, as an alternative to this or in addition to it, can include one or several further control elements. In particular, the at least one control element can be provided at an inlet region of the cleaning apparatus such that a user, who charges the conveying device with articles to be cleaned at the inlet region, is able to operate the control element. The display device can also be provided in such a manner that a user, who is located in the inlet region of the cleaning apparatus and charges the conveying device there with articles to be cleaned, is able to recognize the proposal communicated by means of the display device with regard to the operating mode and is able to confirm or reject this, for example, by means of the control element without having to leave the inlet region. If several proposals are provided, the confirmation can thus also generally include a selection of several proposals.

Confirmation of the selected operating mode by the user ensures, for example, that it is also possible to consider information which is not available to the control means. For example, the user can recognize that the conveying device certainly has a smaller occupancy of articles to be cleaned at the moment, but in the immediate future a greater occupancy is to be expected, for example on account of the user recognizing that more articles to be cleaned are immediately to arrive. In this case, the user can reject the proposal to reduce the tracks, for example. In each case, the user is able to maintain control of the process.

As stated above, the display device can be set up, in particular, to identify one or several tracks of the conveying device so as to be visible to the user. The display device can be or include, for example, a display device which is coupled with a control element or associated with a control element, for example a display of a machine control means. As an alternative to this or in addition to it, the display device, as is developed in more detail below, can, however, be provided or developed especially for identifying the tracks of the conveying device. For example, said identification can include an arbitrary reference to the tracks, for example a mechanical reference in the form of a mechanical display and/or a visual reference. In particular, said reference can be a visual reference in the form of a lamp of one or of several tracks of the conveying device. Thus, the display device can include, for example, at least one illuminating device, wherein the illuminating device is set up in order to select in an optional manner one or several tracks of the conveying device from the overall number of tracks and to illuminate them selectively in order to mark said one or several tracks for occupancy with articles to be cleaned. The illuminating device can include, for example, a plurality of light-emitting diodes. Other illuminating means can also be used, however, as an alternative to this or in addition to it, for example bulbs or gas-discharging lamps. The conveying device can be illuminated from above or also from below or also from the inside. Thus, for example, tracks of a conveyor belt of the conveying device can be selectively illuminated from above and/or selectively illuminated from below. Where illuminated from below, the conveyor belt can be developed, for example, completely or in part in a transparent manner. As an alternative to this or in addition to it, illuminating means, which enable the selective illumination of one or of several tracks can also be provided inside the conveyor belt.

As stated above, the nozzle system can comprise, in particular, at least one switchable nozzle system, wherein the switchable nozzle system comprises at least two nozzle units which are arranged at different positions transversely with respect to the conveying direction, wherein the nozzle units are switchable independently of one another in order to act upon the articles to be cleaned with cleaning fluid at different positions independently of one another. In particular, the optional dividing of the conveying device into two or more tracks can correlate with the dividing of the nozzle system into two or more nozzle units. Thus, for example, each track can have associated therewith one or several nozzle units which can act with cleaning fluid upon the articles to be cleaned which are conveyed on the respective track.

The abovementioned selected operating mode can include, in particular, at least one switching state of the switchable nozzle system. Thus, for example, a plurality of possible operating modes can be filed in the control means of the cleaning apparatus, in each operating mode one or several tracks to be occupied with articles to be cleaned being provided from the overall number of possible tracks and a corresponding switching state of the switchable nozzle system to the effect that articles to be cleaned which are placed on the one track to be occupied or on the several tracks to be occupied, are acted upon with cleaning fluid in the switching state. If then, one operating mode is selected from the number of possible operating modes, proposed to the user and confirmed by the user, the control means can thus be set up to activate, for example, simply the nozzle units or the nozzle units which are associated with the track to be occupied or the tracks to be occupied of the selected operating mode, whereas other nozzle units are disengaged.

As an alternative to or in addition to the above-described method of operation, the user can confirm the proposal, as stated above, in a different manner. Thus, for example, as stated above, one or several tracks to be occupied with articles to be cleaned can be proposed to the user. If the articles to be cleaned are placed onto the conveying device, the cleaning apparatus can detect the occupied tracks for example by means of the at least one sensor for the articles to be cleaned, and the control means can implement the proposal, for example, corresponding to said occupancy and for example activate the nozzle units associated with the occupied track or the occupied tracks, whereas other nozzle units can be disengaged.

As stated above, the switchable nozzle system can comprise at least one final rinse nozzle system for acting upon the articles to be cleaned with at least one final rinse fluid, in particular fresh water. Particularly preferred for a final rinse nozzle system is a switchable development as such a final rinse nozzle system, in practice, is operated with a high demand for fresh water and heat energy, that is to say is operated in a particularly resource-consuming manner. The final rinse nozzle system can comprise at least two final rinse nozzle units which are arranged at different positions transversely to the conveying direction, wherein the final rinse nozzle units are switchable independently of one another in order to act with the final rinse fluid upon the articles to be cleaned at different positions independently of one another.

In general, the switchable nozzle system can comprise in particular at least two or at least three nozzle units arranged side by side transversely with respect to the conveying direction, preferably at least four and in a particularly preferred manner at least six nozzle units. Each nozzle unit can have, for example connected upstream, an associated switching element, the associated switching element being able to switch the nozzle unit by means of the associated switching element to act upon the articles to be cleaned. The switching element can be selected, for example, from the group consisting of: a valve, in particular a magnetic valve and/or an electro-magnetic valve and/or a valve with at least one piezo actuator; a slide, in particular a mechanically operable slide; and a tap.

As stated above, the control means can be set up, in particular, to switch the nozzle units. The control means can be set up in particular to combine several nozzle units, where necessary, to form groups, the nozzle units being switched together in each case in a group.

The control means can be set up, in particular, to deduce from a current loading of the conveying device with articles to be cleaned an expected future loading, to propose to the user, corresponding to the expected future loading, by means of the display device, occupancy of one or of several selected tracks of the conveying device with articles to be cleaned and leaving the remaining conveying device free and to switch the nozzle units corresponding to the one or several selected tracks such that just the one or several selected tracks are acted upon with cleaning fluid. The actual switching of the nozzle system by the control means can be effected as an option and preferably, as stated above, not before the user has confirmed said proposed operating mode. In addition, the control means can be set up as an option to detect, by means of the sensor for articles to be cleaned, non-selected tracks which have been incorrectly occupied with articles to be cleaned and to switch the nozzle units such that additionally the non-selected tracks which have been incorrectly occupied with articles to be cleaned are acted upon with cleaning fluid in the short term. Once the incorrect occupancy has been terminated, for example the acting upon the non-selected tracks which have been incorrectly occupied with articles to be cleaned can be ended again.

The nozzle system can comprise, for example, at least two nozzle units arranged at different positions transversely with respect to the conveying direction. The conveying direction consequently defines, at least locally at the site of the nozzle system, a direction in space. Transversely with respect to said direction in space, the nozzle system defines at least one further direction in space. The term "transversely" in this case is to be understood as a direction in space which runs non-parallel to the conveying direction. This can preferably be, in this case, a direction in space perpendicular to the conveying direction at the site of the nozzle system, that is a direction in space which extends at 90° to the conveying direction. In this case, however, deviations from exact orthogonality can also occur, preferably deviations by no more than 45°, for example by no more than 30°, for example by no more than 20° and in a particularly preferred manner by no more than 10° or even no more than 5°.

Consequently, the nozzle system preferably comprises at least two nozzle units. A nozzle unit, in this case, as stated above, is to be understood as a unit of the nozzle system which includes at least one nozzle, that is an element with at least one opening, through which the cleaning fluid, in particular the final rinse fluid, is able to emerge, that is able to drip out, squirt out or spray out. Consequently, the nozzle system preferably comprises two, three, four, five, six or more such nozzle units which are arranged transversely with respect to the conveying direction such that they are arranged in at least two different positions transversely with respect to the conveying direction. For example, the nozzle system can include at least one nozzle arm which is arranged transversely with respect to the conveying direction and which comprises the at least two nozzle units. Consequently, when viewed in the conveying direction, there are at least two nozzle units arranged side by side. Thus, for example, the conveying direction can comprise a conveying width, that is a maximum width which can be occupied by the articles to be cleaned. Said conveying width can also be designated as a passage width. The nozzle system is preferably developed in such a manner that the nozzle units, in particular the final rinse nozzle units, cover the entire conveying width of the conveying device. The nozzle units can form, for example, a chain of nozzle units which are arranged transversely with respect to the conveying direction and which are able to spray or squirt the entire width of the conveying device, for example the entire width of the conveyor belt.

The nozzle units, in this case, are preferably switchable independently of one another in order to act upon the articles to be cleaned with final rinse fluid at the different positions independently of one another. The term "switch" is to be understood in this case in general within the framework of the present invention in conjunction with a nozzle unit as an actuation of the emerging of the fluid out of the nozzle unit. A nozzle unit is to be understood as a unit of one or several nozzles which are controllable together in this way. For example, the switching operation can be a digital switching operation, where it is possible to switch between one state in which fluid emerges out of the nozzle unit (switched state), and a non-switched state in which no fluid emerges out of the nozzle unit. As an alternative to a purely digital state (realizable, for example, by means of an on/off switching element) the switching operation can also include one or several intermediate states and/or intermediate switching states or a stepless switching operation, it being possible to provide, between the above-described states of the switched state and of the non-switched state, one or several intermediate states where fluid emerges out of the nozzle unit at a volume flow and/or mass flow which is reduced in comparison to the switched state.

In order to carry out the above-described switching operation, numerous different technical possibilities are conceivable which are known in principle to the expert. For example, one or several switching elements can be provided to carry out the switching operation. Thus, one or several switching elements can be provided, for example, for the switching of the nozzle units, in particular switching elements of the above-described type. The at least one switching element can be set up, in particular, to interrupt or enable at least one supply of final rinse fluid to the nozzle units. As an alternative to this or in addition to it, the switchability can also be effected for example by several separate pump systems such that, for example, the switching operation is able to include pressurization of the respective nozzle units or non-pressurization. Other technical realizations are also conceivable in principle and are known in principle to the expert.

The term "switchable independently of one another" is to be understood in this case in general within the framework of the present invention as the at least two nozzle units preferably being switchable in such a manner that one nozzle unit can be switched independently of the switching of another nozzle unit. Consequently, at least one switching state can preferably be chosen for each nozzle unit, irrespective of the switching state in which one or several other nozzle units are situated. Consequently, selective switching of the nozzle units can be effected in particular, in particular selective switching of the individual final rinse nozzle units of a pumped final rinse and/or of a fresh water final rinse. In this way, the articles to be cleaned can be acted upon with cleaning fluid at the at least two above-described different positions independently of one another transversely with respect to the conveying direction. In said context, acting independently with cleaning fluid is to be understood as, in at least one first of the different positions, an emerging or non-emerging of cleaning fluid from a nozzle unit arranged there being switchable in order to act upon the articles to be cleaned, irrespective of whether, in at least one second position of the different positions, cleaning fluid is also emerging from the nozzle unit located there.

As stated above, the cleaning apparatus can be selected, in particular, from the group consisting of a conveyor dishwashing machine and a rack conveyor dishwashing machine. Accordingly, the conveying device can include for example at least one element selected from the group consisting of: a conveyor belt; a conveyor chain; a conveyor roller; sliding elements or guiding elements, in particular one or several rails; a latch conveyor. For example, the conveying device can include at least one conveyor belt and/or at least one conveying chain and/or one or several conveying rollers and/or sliding elements with a latch conveyor. Other developments are also possible. The conveying device can be stacked side by side with several items of the articles to be cleaned in particular transversely with respect to the conveying direction. Thus, the conveying device can comprise, for example transversely with respect to the conveying direction, for example perpendicular to the conveying device, a conveying width of at least 300 mm. For example, conveying widths of 500 mm or more, 750 mm or more, 1000 mm or more or even 1200 mm or more can be provided. The conveying width can be predetermined, for example, by a corresponding width of a conveyor belt of the conveying device which is able to be stacked to the maximum with articles to be cleaned.

The nozzle system can have in particular at least three nozzle units, for example final rinse nozzle units, arranged side by side transversely with respect to the conveying direction. In particular, at least two, at least three, at least four and particularly preferably at least six nozzle units can be provided. Each nozzle unit, in turn, can have one or several nozzles, for example one or several outlet openings for the cleaning fluid, for example the final rinse fluid. The nozzle units can be arranged, for example, in at least one nozzle arm which is arranged transversely with respect to the conveying direction. A nozzle arm is to be understood in this case, for example, as a rigidly installed or also pivotable arm which provides a mechanical support for the nozzle units, for example the final rinse nozzle units, and preferably also a supply of cleaning fluid, for example the final rinse fluid. As an alternative to or in addition to the arrangement in a nozzle arm, the nozzle units can also, however, be arranged, for example, in a ceiling part and/or floor part of the cleaning chamber and/or in another manner in the cleaning apparatus. As is stated in more detail below, the nozzle units can comprise, for example, at least one first group of nozzle units above the articles to be cleaned and at least one second group of nozzle units below the articles to be cleaned, for example one nozzle arm which is arranged above the conveying device and acts upon the articles to be cleaned from above with cleaning fluid, and at least one nozzle arm which is arranged below the articles to be cleaned and acts upon the articles to be cleaned from below with cleaning fluid.

Further optional developments relate to the optional independent switchability of the nozzle units. This can be ensured, for example, as a result of each nozzle unit having connected upstream an associated valve, the associated valve being switchable in order to switch the nozzle units to act upon the articles to be cleaned. As described above, said switching can be digital switching between a switched state and a non-switched state or even switching which enables one or several intermediate positions, in steps or also steplessly. As stated above, as an alternative to or in addition to the switching by means of at least one valve, other developments are also conceivable, for example developments by means of independent pressurization such that, for example, to switch a nozzle unit, the respective nozzle unit can be pressurized with pressurized cleaning fluid, for example by means of a corresponding pump, the pressurization being removed, for example, for disengagement.

In particular, the at least one switching element can be electrically switchable such that it is switchable, for example, by a control means of the cleaning apparatus. As an alternative to this or in addition to it, however, mechanically, pneumatically and also hydraulically actuatable switching elements can be used, for example, for the independent switchability of the at least two final rinse nozzle units.

The nozzle units can be acted upon in particular in each case by means of at least one supply with final rinse fluid. The nozzle units, in this case, for example, can be fed by means of a common supply, for example from a tank and/or by means of a supply line such as, for example, a fresh water supply line. If the nozzle system includes, for example, a pre-wash system, the nozzle units of the pre-wash system can thus be fed, for example, from a pre-wash tank. If the nozzle system includes, for example, a main system or wash system, the nozzle units of the wash system can thus be supplied, for example, from a wash tank. If the nozzle system includes, for example, a final rinse system, the nozzle units of the final rinse system can be supplied, for example, from a final rinse tank, in particular in the case of a pumped final rinse, and/or from a fresh water supply line, for example by means of a boiler or by means of an instantaneous water heater. Other developments are also possible.

In particular, the nozzle units of a fresh water final rinse can be supplied by means of a common fresh water supply. As an alternative to this or in addition to it, the final rinse nozzle units, however, can also have independent final rinse fluid supplies. The final rinse nozzle units, if a common final rinse fluid supply is provided, can be connected, for example, to the common final rinse fluid supply by means of final rinse lines, it being possible, for example, for at least one associated switching element to be arranged in each case in each final rinse line. For example, the common final rinse fluid supply can include a common final rinse tank and/or a common preparation device for final rinse fluid. As an alternative to this or in addition to it, the common final rinse fluid supply can also include a common fresh water supply, for example a common fresh water tap and/or a common fresh water connection, for example on the building side, by means of which all the final rinse nozzle units can be supplied with fresh water. For example, the cleaning apparatus can include a central connection for fresh water which is connectable to a common fresh water supply on the building side, the common connection then branching and running, for example, by means of final rinse lines directly or indirectly to the individual final rinse nozzle units. In this case, for example, one or several switching elements can be interposed and/or one or several preparation devices. Said elements can be arranged, for example, in the individual final rinse lines and/or prior to a branching of the individual final rinse lines.

The cleaning fluid supply to the nozzle units can be equipped, in particular with at least one additional regulating member. Said at least one optional regulating member can be set up, in particular, to keep a hydraulic pressure constant in the nozzle system, for example in the final rinse system. The achievement of said regulating member is that there is always a constant pressure in the nozzle units, even when individual or several nozzle units have been disengaged. The term "constant" is to be understood in this case preferably as an absolute constancy, deviations and/or oscillations, which are preferably no more than 50% of an average pressure, in particular no more than 20% of the average pressure and in a particularly preferred manner no more than 10% however, also being able to be tolerable in principle. The optional at least one regulating member provides the advantage that pressure oscillations which occur when the nozzle units are switched can be avoided at least extensively. In particular, without the regulating member, the case can occur where, under unfavorable conditions, the pressure in the system increases and a greater quantity of cleaning fluid flows through the remaining switched nozzle units. The optional at least one regulating member can consequently further support the effect of the invention, namely the saving of cleaning fluid, in particular final rinse fluid. The at least one optional regulating member can be arranged, for example, in one or several portions of a cleaning fluid supply to the nozzle units. In this case, for example, each nozzle unit can have associated therewith one regulating member, or one common regulating member can be provided for a group of nozzle units.

The at least one optional regulating member, once again, for example, can include at least one valve, coupled for example with at least one sensor, in particular at least one flow rate sensor and/or at least one pressure sensor. For example, the at least one regulating member can include at least one needle valve, for example at least one needle valve actuated by electric motor. A valve position can be adjusted or regulated, for example, by means of a signal of the sensor in such a manner that a constant pressure prevails in the cleaning fluid. For example, at least one regulator can be provided for this purpose.

The cleaning apparatus can further comprise at least one preparation device. A preparation device is to be understood in this case in general as a device which is set up to adjust at least one property of the cleaning fluid, for example of the final rinse fluid, before said cleaning fluid is supplied to the nozzle system. For example, said at least one property can be selected from the group consisting of a temperature of the cleaning fluid, a purity of the cleaning fluid and a concentration of at least one component of the cleaning fluid, for example of a cleaning agent concentrate, of a disinfection means or of a rinse agent. Accordingly, the preparation device can be selected, for example, from the group consisting of: a tempering device for adjusting a temperature of the cleaning fluid, in particular a heating device and, particularly preferred, an instantaneous water heater and/or a boiler; a preparation system for adjusting a purity of the cleaning fluid, in particular a filter and/or an osmosis system (which also includes the possibility of a reverse osmosis system); a dosing device for adjusting at least one concentration of a component of the cleaning fluid. As an alternative to this or in addition to it, other types of preparation devices are also conceivable.

For further possible developments of the cleaning apparatus according to the invention, in particular with reference to the switching of the nozzle units and/or to the dividing of the cleaning chamber into cleaning zones, reference can be made extensively to the above-named prior art, in particular to named DE 10 2012 211 442. The techniques shown there can also be used within the framework of the present invention, where an operating mode is proposed to a user. Furthermore, the switching states described there with reference to the final rinse nozzle system can also be transferred within the framework of the present invention to other nozzle systems of the cleaning apparatus.

In a further aspect of the present invention, a method for cleaning articles to be cleaned is proposed, said method including conveying the articles to be cleaned by means of at least one conveying device through at least one cleaning chamber of a cleaning apparatus, additionally including acting upon the articles to be cleaned with at least one cleaning fluid by means of at least one nozzle system, additionally including detecting a loading of the conveying device with articles to be cleaned by means of at least one sensor for articles to be cleaned, additionally including selecting at least one an operating mode of the cleaning apparatus corresponding to the detected loading of the conveying device with the articles to be cleaned, and additionally including proposing the selected operating mode by means of at least one display device to a user of the cleaning apparatus. The method steps shown can be carried out in the named sequence or also in another sequence. Furthermore, one method step, several method steps or also all the method steps can also be carried out overlapping in time or in parallel. Furthermore, one or several or also all of the method steps can be also be carried out repeatedly. The method can include further method steps over and above this which have not been named.

The method can be carried out in particular using the cleaning apparatus according to the invention, for example according to one or several of the embodiments described above or described in more detail below. Accordingly, for the development of the method steps reference can be made extensively to the description of the cleaning apparatus. Other developments, however, are also possible.

The proposed cleaning apparatus and the proposed method comprise numerous advantages compared to known cleaning apparatuses and methods. Thus, the above-described disadvantages and technical challenges of known cleaning apparatuses can be avoided according to the invention at least in part. Thus, the at least one sensor for the articles to be cleaned can be used for the occupancy of the cleaning apparatus, for example the dishwashing machine, and/or signals of the at least one sensor for articles to be cleaned can be used to generate a pattern of the cleaning apparatus. Corresponding to the pattern, the control means of the cleaning apparatus can select for example one or several operating modes, for example different behavior patterns or strategies for operation and for charging the cleaning apparatus and propose them to the operator or the operating personnel. The at least one proposal can include, for example, at least one proposal for modifying the operation and can be displayed by means of the displaying device, for example on a control field of a machine control means of the cleaning apparatus.

The display device can be developed in principle in one part or multiple parts and can also be combined, for example, completely or in part, with the optional at least one control element. Thus, for example, next to a first control and display field, a further control field can be arranged, for example at the inlet region of the dishwashing machine such that the operating personnel can recognize displays directly at their workplace and can also undertake operating steps. In principle, several additional control and/or display fields can also be arranged around or on the conveyor dishwashing machine. As an alternative to or in addition to the message on the display and control field, visual and/or acoustic signals can be output.

For example, the control means can recognize that only a 50% occupancy is present and can accordingly propose to the operator occupying only half of the conveying device, for example of the conveyor belt, for example one of two possible tracks. For example, said proposal is effected as a result of the regions or tracks of the conveying device, for example of the conveyor belt which is to be loaded with articles to be cleaned, being illuminated. As a result, the user, for example the operating personnel, can very easily recognize where articles to be cleaned are to be placed ideally onto the cleaning apparatus, for example onto the conveyor belt. Together with the present track-wise actuation of function elements, for example the above-mentioned nozzle units, a clear savings potential is then provided in the case of said part-loading operation.

The illuminating of the conveying device, for example of the conveyor belt, can be effected, for example, such that an illuminating device is arranged directly at a portal of a rinse chamber, that is for example at an inlet opening of the rinse chamber or cleaning chamber, by means of said illuminating device the conveying device is able to be irradiated for example from above. As an alternative to this or in addition to it, at least one track for example, for example a corresponding part of the conveyor belt, could also be illuminated from below in the inlet region. As an alternative to this or in addition to it, the corresponding part of the conveying device can also be illuminated from the start of the cleaning apparatus, for example. Other arrangements of the display device, for example of the illuminating and/or signaling device, are also conceivable.

The illuminating can be developed in one color, for example white or another color, or can be developed in multiple colors, for example so as also to display several operating states, several occupancies or even incorrect occupancies differently. The illuminating can be actuated constantly or also non-constantly, for example flashing. Using a flash lamp, for example, is also conceivable.

As an alternative to or in addition to the illuminating of the at least one proposed track of the conveying device, for example of the preferred belt region, another type of visual signaling can also be provided at the inlet of the cleaning apparatus. For example, a luminous band can be arranged above the inlet opening of the cleaning chamber, preferably over the entire width of the conveying device, said luminous band being set up for the purpose of illuminating, completely or also only in part, and thus of identifying a proposed region of the conveying device. For example, once again, a visual signal device can be arranged above an opening of the cleaning apparatus, for example above a portal, e.g. in the form of one or several traffic lights which either illuminate as the occupancy proposal, or which change the colors and/or the pattern of the light signal. Thus, for example, analogous to a road traffic control means, a display can be effected by means of one or several crosses and/or arrows such that, for example, an arrow points to the track to be occupied and a cross to a track that is not to be occupied. In this way, it is easily possible to switch between different occupancy proposals, and the proposals can be shown in an intelligible manner without any great expenditure on training and without the user having to have any specific language knowledge.

Furthermore, mechanical and/or electro-mechanical signal devices, which can signalize the proposal for a certain operating mode, for example a certain track, are conceivable as an alternative to or in addition to display devices by means of light signals.

Furthermore, the proposal of the control means can also contain a proposal with regard to a certain cleaning program. Thus, it can be proposed to the user, for example to the operating personnel, to select another program, for example by means of a control surface. Said proposed other program can include, for example, a different conveying speed of the cleaning apparatus. Thus, for example, a slower conveying speed, for example a slower belt speed, can be chosen in order to avoid too large gaps with unoccupied portions occurring on the conveying device. Other contents of the proposed programs are also conceivable.

As a result of the invention, the operating personnel or the operator maintains complete dominance over the operation and the method of operation of the conveyor dishwashing machine. Preferably no operating parameters are automatically reversed on account of signals at available occupancy sensors. Thus, for example, in a preferred manner there is no automatic changing of a cleaning program, for example a rinse program, for example as a result of automatic switching to a different conveying speed.

As a result of the development of the cleaning apparatus according to the invention, it can be ensured, for example, that the operating personnel can easily recognize where articles to be cleaned are to be placed ideally onto the cleaning apparatus, for example onto the conveyor belt. Together with the present track-wise actuation of function elements, for example the above-mentioned switchable nozzle units, a clear savings potential is then provided for example in the case of a sensible part-loading operation that is adapted to requirements.

Furthermore, the control means can also be set up to detect whether, once the proposal has been confirmed and the proposal has started to be implemented, the at least one user implements the proposal correctly. Thus, for example, it can be recorded and optionally stored as to whether, corresponding to the proposal, the user or users occupy certain segments of the conveying device with articles to be cleaned and not other segments. In this way, it is subsequently possible for a supervisory person, for example a kitchen manager, to check whether the proposal has been correctly implemented and/or whether the respective instructions have been correctly followed.

In the case of large conveying widths, for example belt widths in excess of 900 mm, two or more operating persons are frequently placed in normal mode at the inlet of the cleaning apparatus, for example of the dishwashing machine. If the track concept is then strictly implemented in part loading mode, the second operating person can be removed, for example, at least temporarily from said position and carry out other tasks.

A further advantage of the present invention consists in that simply less structural expenditure is necessary to implement the invention in existing cleaning apparatuses. Thus, within the framework of the present invention, it is possible, for example, to use sensors and components which are installed anyway in a conveyor dishwashing machine. The invention can be implemented, for example, as a result of processing signals in a suitable manner and by using additional software, for example simply a suitable display device and for example selective track illumination. In spite of said slight structural expenditure, a clear increase in efficiency is possible, for example in the case of part loading operating states.

In summary, within the framework of the invention the following embodiments are preferred:

EMBODIMENT 1

A cleaning apparatus for cleaning articles to be cleaned, in particular a tunnel dishwashing machine, including at least one cleaning chamber and at least one conveying device, wherein the conveying device is set up to convey the articles to be cleaned in a conveying direction through the cleaning chamber, wherein the cleaning apparatus comprises at least one nozzle system for acting upon the articles to be cleaned with at least one cleaning fluid, wherein the cleaning apparatus additionally comprises at least one sensor for the articles to be cleaned, wherein the sensor for the articles to be cleaned is set up in order to detect a loading of the conveying device with articles to be cleaned, wherein the cleaning apparatus additionally comprises at least one control means and at least one displaying device, wherein the control means is set up in order to select at least one operating mode of the cleaning apparatus corresponding to the detected loading of the conveying device with the items to be cleaned and to propose the selected operating mode by means of the displaying device to a user of the cleaning apparatus.

EMBODIMENT 2

The cleaning apparatus as claimed in the preceding embodiment, wherein the selected operating mode comprises at least one operating parameter, selected from the group consisting of: future or preferred occupancy of the conveying device with items to be cleaned, in particular utilization of one or several tracks of the conveying device; conveying speed of the conveying device; a cleaning program; activation of one or several nozzles of the nozzle system; deactivation of one or several nozzles of the nozzle system.

EMBODIMENT 3

The cleaning apparatus as claimed in one of the preceding embodiments, wherein the control means are additionally set up in order to await confirmation of the proposed selected operating mode by the user and not to implement the proposed operating mode until confirmation by the user.

EMBODIMENT 4

The cleaning apparatus as claimed in the preceding embodiment, wherein the control means is set up in order to detect confirmation of the proposed selected operating mode by a predetermined or pre-determinable action of the user, in particular an occupancy of one or several tracks of the conveying device with articles to be cleaned.

EMBODIMENT 5

The cleaning apparatus as claimed in one of the preceding embodiments, wherein the cleaning apparatus additionally comprises at least one control element which is operable by the user, wherein the control means is additionally set up in order to await confirmation of the proposed selected operating mode by the user by means of the control element and not to implement the proposed operating mode until confirmation by the user.

EMBODIMENT 6

The cleaning apparatus as claimed in one of the preceding embodiments, wherein the display device is set up in order to make one or several tracks of the conveying device visible to the user.

EMBODIMENT 7

The cleaning apparatus as claimed in one of the preceding embodiments, wherein the display device includes at least one illuminating device, wherein the illuminating device is set up in order to select in an optional manner one or several tracks of the conveying device from the overall number of tracks and to illuminate them selectively in order to mark said one or several tracks for occupancy with articles to be cleaned.

EMBODIMENT 8

The cleaning apparatus as claimed in the preceding embodiment, wherein the illuminating device includes a plurality of light-emitting diodes.

EMBODIMENT 9

The cleaning apparatus as claimed in one of the preceding embodiments, wherein the sensor for the articles to be cleaned is selected from the group consisting of: an electric sensor for the articles to be cleaned; a capacitive sensor for the articles to be cleaned; an inductive sensor for the articles to be cleaned; an electro-mechanical sensor for the articles to be cleaned; a mechanical sensor for the articles to be cleaned; an infrared sensor for the articles to be cleaned; an ultrasound sensor for the articles to be cleaned; an optical sensor for the articles to be cleaned; an imaging sensor.

EMBODIMENT 10

The cleaning apparatus as claimed in one of the preceding embodiments, wherein the nozzle system comprises at least one switchable nozzle system, wherein the switchable nozzle system comprises at least two nozzle units which are arranged at different positions transversely with respect to the conveying direction, wherein the nozzle units are switchable independently of one another in order to act upon the articles to be cleaned with cleaning fluid at different positions independently of one another.

EMBODIMENT 11

The cleaning apparatus as claimed in the preceding embodiment, wherein the selected operating mode includes at least one switching state of the switchable nozzle system.

EMBODIMENT 12

The cleaning apparatus as claimed in either of the two preceding embodiments, wherein the switchable nozzle system comprises at least one final rinse nozzle system for acting upon the articles to be cleaned with at least one final rinse fluid, in particular fresh water, wherein the final rinse nozzle system comprises at least two final rinse nozzle units which are arranged at different positions transversely to the conveying direction, wherein the final rinse nozzle units are switchable independently of one another in order to act upon the articles to be cleaned with the rinse fluid at different positions independently of one another.

EMBODIMENT 13

The cleaning apparatus as claimed in one of the three preceding embodiments, wherein the switchable nozzle system comprises at least two, preferably at least three nozzle units arranged side by side transversely with respect to the conveying direction, in particular at least four and particularly preferred at least six nozzle units.

EMBODIMENT 14

The cleaning apparatus as claimed in one of the four preceding embodiments, wherein an associated switching element is connected upstream of each nozzle unit, wherein the associated switching element is switchable in order to switch the nozzle unit by means of the associated switching element to act upon the articles to be cleaned.

EMBODIMENT 15

The cleaning apparatus as claimed in the preceding embodiment, wherein the switching element is selected from the group consisting of: a valve, in particular a magnetic valve and/or an electro-magnetic valve and/or a valve with at least one piezo actuator; a slide, in particular a mechanically operable slide; a tap.

EMBODIMENT 16

The cleaning apparatus as claimed in one of the six preceding embodiments, wherein the control means is set up to switch the nozzle units.

EMBODIMENT 17

The cleaning apparatus as claimed in the preceding embodiment, wherein the control means is set up to combine several nozzle units, where necessary, to form groups, the nozzle units being switched together in each case in a group.

EMBODIMENT 18

The cleaning apparatus as claimed in either of the two preceding embodiments, wherein the control means is set up in order to deduce from a current loading of the conveying device with articles to be cleaned an expected future loading, to propose to the user by means of the display device, corresponding to the expected future loading, occupancy of one or of several selected tracks of the conveying device with articles to be cleaned and leaving the remaining conveying device free and to switch the nozzle units corresponding to the one or several selected tracks such that only the one or several selected tracks are acted upon with cleaning fluid.

EMBODIMENT 19

The cleaning apparatus as claimed in the preceding embodiment, wherein the control means is set up to detect, by means of the sensor for articles to be cleaned, non-selected tracks which have been incorrectly occupied with articles to be cleaned and to switch the nozzle units such that additionally the non-selected tracks which have been incorrectly occupied with articles to be cleaned are acted upon with cleaning fluid in the short term.

EMBODIMENT 20

A method for cleaning articles to be cleaned, said method including conveying the articles to be cleaned by means of at least one conveying device through at least one cleaning chamber of a cleaning apparatus, additionally including acting upon the articles to be cleaned with at least one cleaning fluid by means of at least one nozzle system, additionally including detecting a loading of the conveying device with articles to be cleaned by means of at least one sensor for articles to be cleaned, additionally including selecting at least one operating mode of the cleaning apparatus corresponding to the detected loading of the conveying device with the articles to be cleaned, and additionally including proposing the selected operating mode by means of at least one display device to a user of the cleaning apparatus.

EMBODIMENT 21

The method as claimed in the preceding embodiment, wherein the method includes the use of the cleaning apparatus as claimed in one of the preceding embodiments which relates to a cleaning apparatus.

BRIEF DESCRIPTION OF THE FIGURES

Further optional details and features of the invention are explained below with reference to preferred exemplary embodiments. The optional features can be realized herein in an isolated manner as well as in any possible combination, as the expert will immediately know. The invention is not restricted by the preferred exemplary embodiments. The exemplary embodiments are shown schematically in the figures. Identical reference signs in the figures designate identical elements or elements which are comparable regarding their function.

The figures are as follows.

EXEMPLARY EMBODIMENTS

Figure 1:
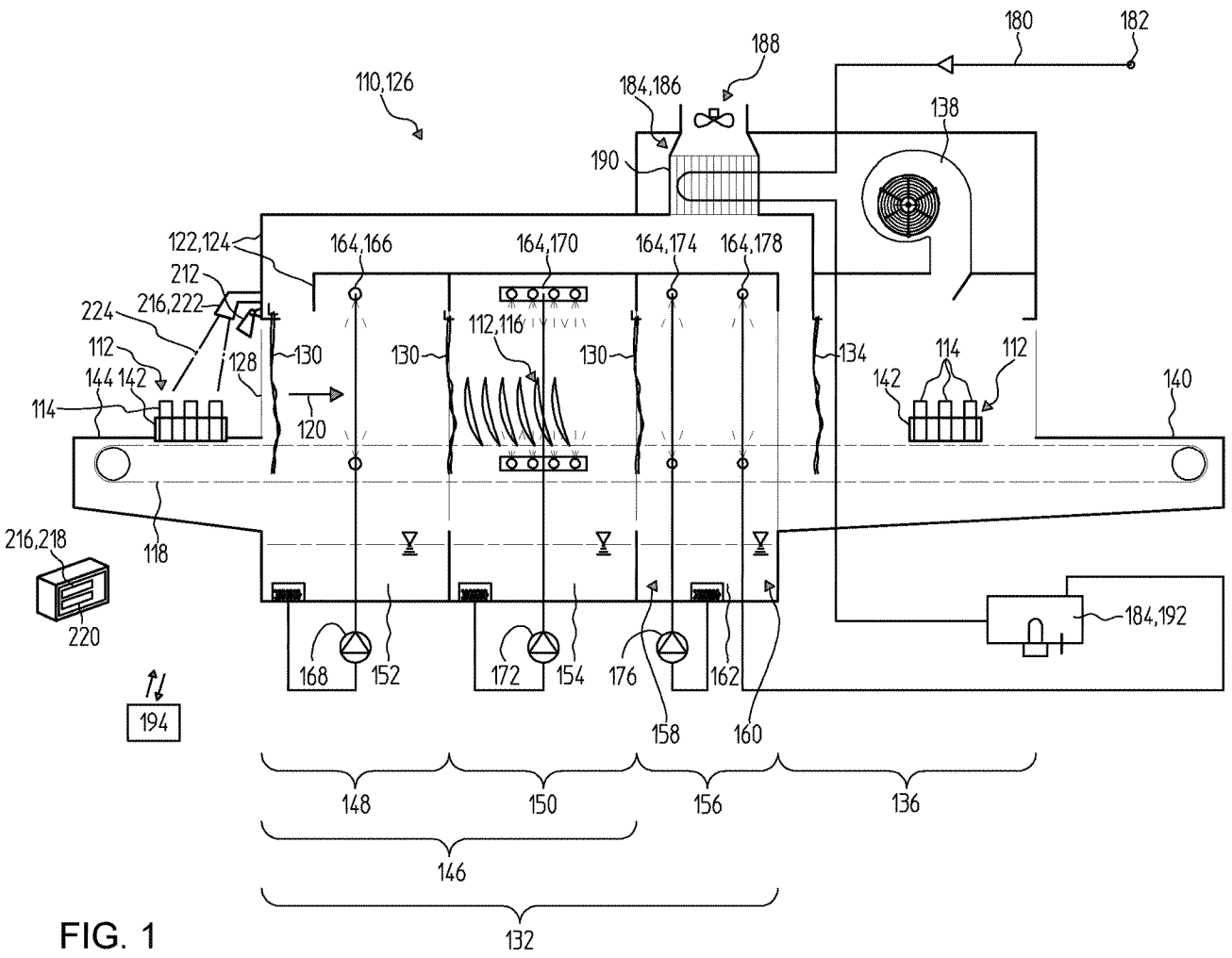
FIG. 1: shows a sectional representation of an exemplary embodiment of a cleaning apparatus in a section plane parallel to a conveying direction.

FIG. 1 shows an exemplary embodiment of a cleaning apparatus 110 according to the invention for cleaning articles to be cleaned 112. The articles to be cleaned 112, which are shown symbolically in FIG. 1, are shown as an example in the form, for example, of glasses 114 and/or plates 116. As an alternative to this or in addition to it, further articles 112 to be cleaned can be inserted or used.

The articles to be cleaned 112 are conveyed in the exemplary embodiment shown by means of a conveying device 118 in a conveying direction 120 through a cleaning chamber 122 of the cleaning apparatus 110. The cleaning chamber 122 can be developed, for example, as a cleaning tunnel 124 and can, for example, comprise a housing.

The cleaning apparatus 110 can be developed therefore in this or also in other exemplary embodiments in general in particular as a conveyor dishwashing machine 126. The articles to be cleaned 112, for example the crockery, are conveyed by means of the conveying device 118 into the interior of the cleaning chamber 122 to an inlet opening 128. The inlet opening 128 can be closed, for example by a partition curtain 130 which can be opened by the articles to be cleaned 112. In the interior of the cleaning chamber 122, the articles to be cleaned 112 run through a plurality of cleaning zones 132 which will be explained in more detail below. Said cleaning zones, in turn, can be separated from one another by partition curtains 130. Finally, the articles to be cleaned 112, for example once again at a partition curtain 134, leave the cleaning chamber 122 and enter, for example, into a drying zone 136. The articles to be cleaned 112 are dried there, for example by means of a blower 138, before the articles to be cleaned 112 are conveyed by the conveying device 118 into an outlet 140 in which they can be removed out of the cleaning apparatus 110.

The conveying device 118 can be or include, for example, a belt conveying device and/or a basket conveying device. For example, at least one conveyor belt can be included. The articles to be cleaned 112 can be placed directly onto the conveying device 118, as shown as an example in FIG. 1 with the example of the plates 116 such that the conveyor dishwashing machine 126 can be developed, for example, as a conveyor belt dishwashing machine. As an alternative to this or in addition to it, the articles to be cleaned 112 can also be placed onto the conveying device 118, for example, by means of one or several conveying baskets 142, as shown as an example in the exemplary embodiment shown with the example of the glasses 114. Accordingly, the cleaning apparatus 110 can be developed, for example, as a rack conveyor dishwashing machine. An inlet 144, at which the articles to be cleaned 112 can be placed directly or indirectly, for example by means of the conveying baskets 142 onto the conveying device 118, can be provided, for example, in each case.

FIG. 1 shows a sectional representation of the cleaning apparatus 110 in a section plane parallel to the conveying direction 120. The arrangement of several cleaning zones 132 is shown there as an example. Thus, said cleaning zones include, for example, a wash zone 146, which, in turn, can once again comprise, for example, a pre-wash zone 148 and a main wash zone 150. The pre-wash zone 148 can also be designated for example, as the advance wash zone. The wash zone 146 can include, for example, two tanks, one pre-wash zone tank 152 and one main wash zone tank 154. In this case, the pre-wash zone tank 152 is preferably connected upstream of the main wash zone tank 154 in the conveying direction 120.

Furthermore, the cleaning zones 132, downstream of the wash zone 146, include a final rinse zone 156. Said final rinse zone 156 can once again include, for example, in turn, a pumped final wash zone 158 and fresh water final rinse zone 160 which is connected downstream of said pumped final rinse zone 158 in the conveying direction 120. The final rinse zone 156 additionally includes a final rinse tank 162, which can also be designated as a final rinse zone tank or as a pumped final rinse zone tank. Consequently, shown as an example in the conveying direction 120 in the exemplary embodiment, are provided the following cleaning zones 132: a pre-wash zone 148, a main wash zone 150, a pumped final rinse zone 158 and a fresh water final rinse zone 160. Another type of arrangement of the cleaning zones 132 is also possible in principle. Furthermore, the following tanks are provided as an example: a prewash zone tank 152, a main wash zone tank 154 and a final rinse tank 162. Another type of arrangement of the tanks is also possible in principle. For example, the purity of a cleaning fluid in the tanks 152, 154 and 162 can increase in the conveying direction 120. This can be realized, for example, as a result of an overflow being provided from the final rinse tank 162 into the main wash zone tank 154 and/or an overflow from the main wash zone tank 154 into the pre-wash zone tank 152.

The cleaning apparatus 110 in the exemplary embodiment shown additionally comprises a plurality of cleaning systems 164 which can be developed in each case as nozzle systems. Said cleaning systems 164 or nozzle systems can include, for example, a pre-wash zone nozzle system 166 which can also be developed as a pre-wash zone spray nozzle system and which can include, for example above and below the articles to be cleaned 112, in each case at least one spray arm. The pre-wash zone nozzle system 166 can be supplied with cleaning fluid from the pre-wash zone tank 152, for example, by means of a pre-wash zone pump 168.

Furthermore, the cleaning system 164 can comprise at least one main wash zone nozzle system 170 which can be developed, for example, as a main wash zone spray nozzle system and which, once again, for example, as shown in FIG. 1, can comprise at least one spray arm above the articles to be cleaned 112 and at least one spray arm below the articles to be cleaned 112. The main wash zone nozzle system 170 can be supplied, for example, with cleaning fluid from the main wash zone tank 154 by means of a main wash zone pump 172.

Several cleaning systems 164 can also be provided inside the final rinse zone 156. Thus, a pumped final rinse zone nozzle system 174, which can comprise, for example, once again, a spray arm above the articles to be cleaned 112 and a spray arm below the articles to be cleaned 112, is provided in the exemplary embodiment shown. Said pumped final rinse zone nozzle system 174, which can be developed once again, for example, as a pumped final rinse zone spray nozzle system, can be supplied, for example, by means of at least one pumped final rinse zone pump 176 with cleaning fluid in the form of final rinse fluid from the final rinse tank 162. Connected downstream of the pumped final rinse zone nozzle system 174 in the conveying direction 120 is additionally provided with a cleaning system 164 in the form of a fresh water final rinse zone nozzle system 178 which, for example, can be developed, once again, as a freshwater final rinse zone spray nozzle system. The latter can be supplied with fresh water, for example, by means of a fresh water inlet 180 from a freshwater connection 182. In this case, one or several preparation devices 184 can be provided for adjusting at least one property of the fresh water. In the exemplary embodiment shown, two tempering devices are provided as an example to heat the fresh water. Thus, for example, a first preparation device 184 can be provided in the form of a heat recovery device 186, for example with a suction blower 188 for sucking-in hot air from the cleaning chamber 122 and a heat exchanger 190 for transferring the recovered heat from the exhaust air to the fresh water.

In addition, a preparation device 184 in the form of an instantaneous water heater 192 and/or a fresh water boiler can be provided, for example in order to heat the fresh water finally to an operating temperature, for example a temperature of between 80° C. and 100° C., for example a temperature of between 85° C. and 95° C. A different development is also possible.

The cleaning device 110 additionally includes a control means 194, for example a control means 194 with a data processing device. The control means 194 can be set up, for example, to control an operation of the cleaning apparatus 110, for example by different sensors being interrogated and/or pumps 168, 172, 176 being actuated and/or by the conveying device 118 being actuated. Different developments are possible and are known in principle to the expert.

The cleaning apparatus 110 can be developed in particular in such a manner that one or several of the abovementioned nozzle systems 164 are developed so as to be switchable. For this purpose, the switchably developed nozzle systems 164 can include in each case, for example, two or several nozzle units which can be switchable individually and selectively, for example switched by means of the control means 194. Said preferred development of the present invention is explained below as an example by way of the example of the fresh water final rinse zone nozzle system 178. As an alternative to this or in addition to it, however, other nozzle systems 164 can also be developed so as to be switchable.

Figure 2:
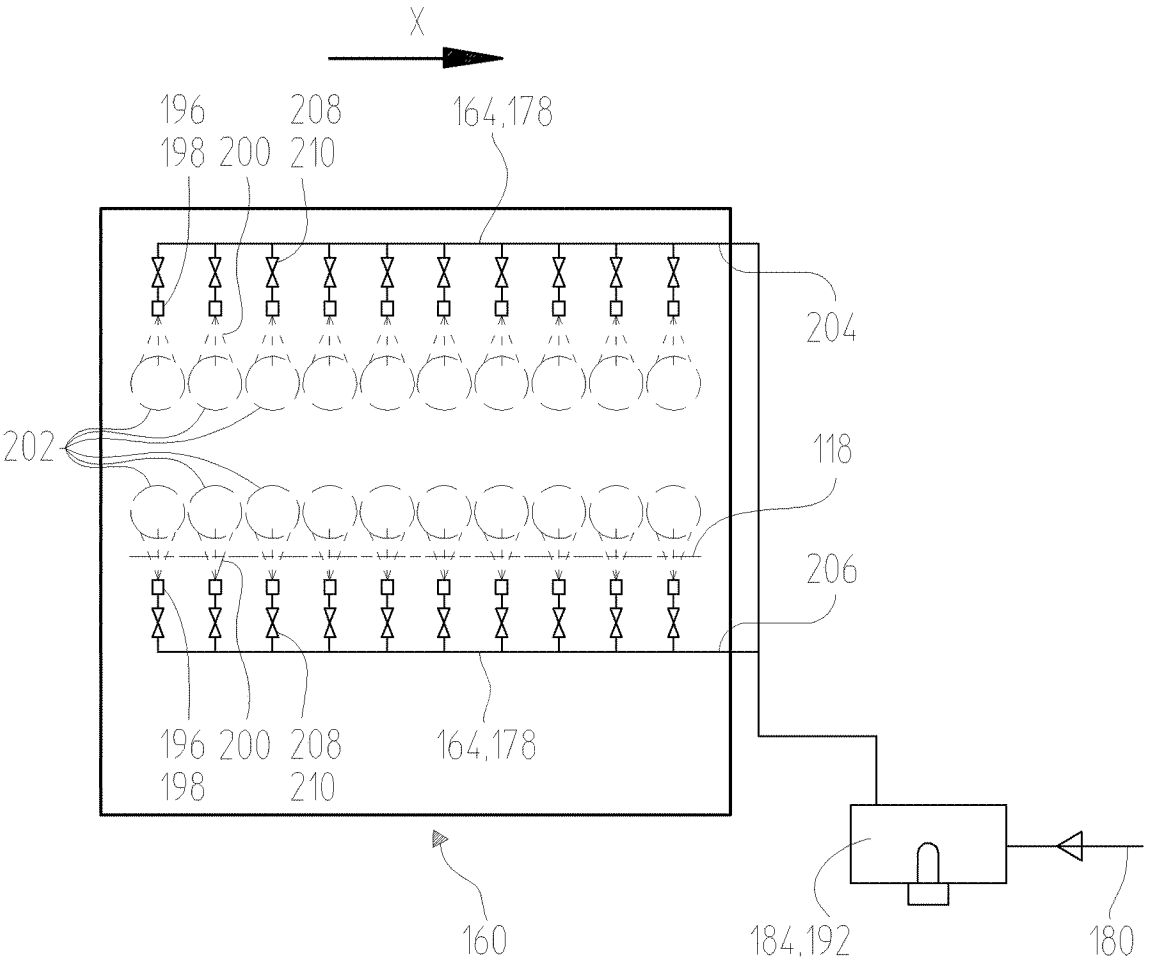
FIG. 2: shows a sectional representation of the exemplary embodiment according to FIG. 1 in a section plane perpendicular to the conveying direction.
Figure 3:
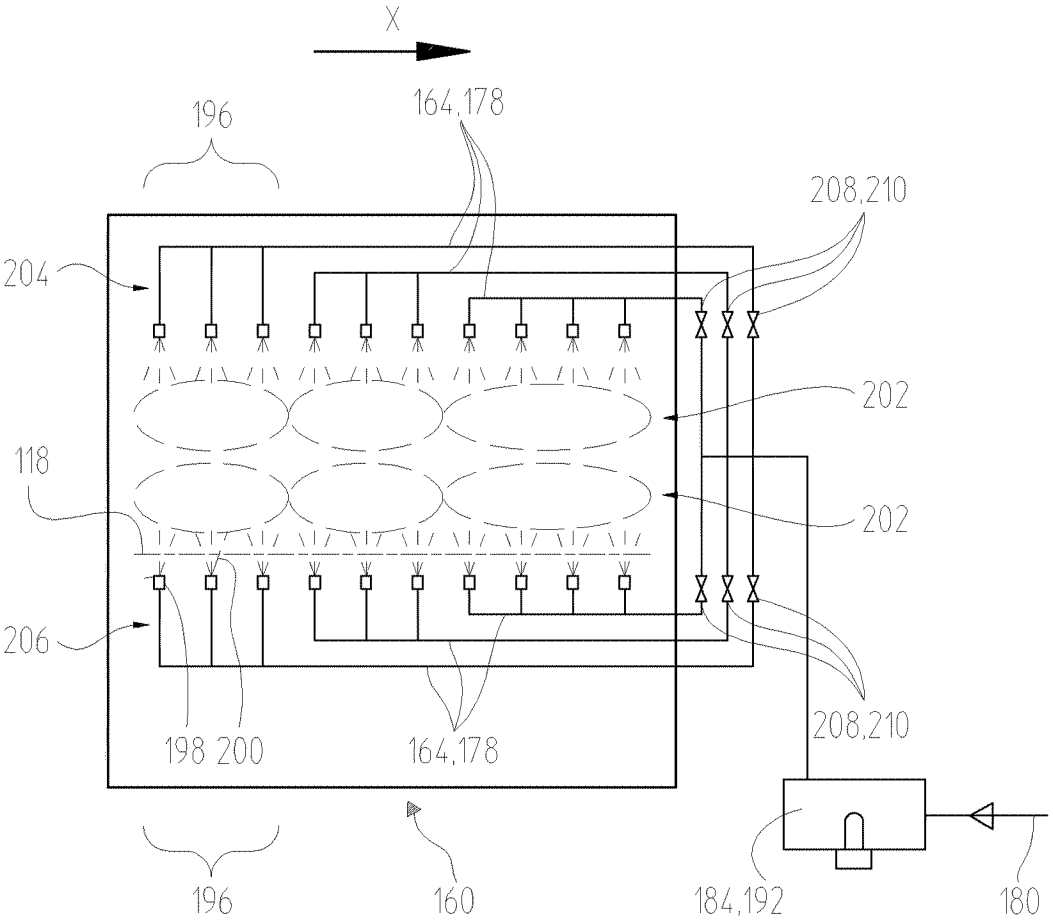
FIG. 3: shows a sectional representation of an exemplary embodiment of a cleaning apparatus alternative to FIG. 2 in a section plane perpendicular to the conveying direction.

As stated above, the cleaning apparatus 110 comprises the fresh water final rinse zone nozzle system 178, by means of which the articles to be cleaned 112 can be acted upon with cleaning fluid in the form of fresh water, where applicable with the admixing of one or several auxiliary materials or additives, for example with the admixing of a final rinse agent. FIGS. 2 and 3, in a sectional representation perpendicular to the conveying direction 120 through the fresh water final rinse zone 160, show two different developments of the fresh water final rinse zone 160. Thus, it can be seen in each exemplary embodiment that the fresh water rinse zone nozzle system includes a plurality of final rinse nozzle units 196. Each of said final rinse nozzle units can include one or several final rinse nozzles 198 which can output, for example, in each case one or several spray jets 200 onto the articles to be cleaned 112 (not shown in FIGS. 2 and 3) on the conveying device 118. The final rinse nozzle units 196, in this case, are arranged in both exemplary embodiments at different positions in a direction running transversely with respect to the conveying direction 120, for example perpendicular to the conveying direction 120. For example, one direction in space is marked in FIGS. 2 and 3 perpendicular to the conveying direction 120 and parallel to a surface of the conveying device 118 by way of a reference x. As can be seen in FIGS. 2 and 3, the final rinse nozzle units 196 are arranged offset to one another in said direction x transversely with respect to the conveying direction 120. As a result, this produces, for the articles to be cleaned on the conveying device 118, a plurality of impingement regions 202, which are located side by side, i.e. offset transversely with respect to the conveying direction in the direction of space x, which are indicated symbolically in FIGS. 2 and 3 and which in each case can be acted upon with final rinse fluid by one or several final rinse nozzle units 196, which are associated with said impingement regions 202. For example, for each impingement region 202, one associated final rinse nozzle unit 196 can be provided above said impingement region 202 and one associated final rinse nozzle unit 196 can be provided below the respective impingement region 202. For example, this can be realized by means of an upper spray arm 204 and a lower spray arm 206. Other developments are also possible.

In both exemplary embodiments in FIGS. 2 and 3, it is provided in this case as an option that the final rinse nozzle units 196 are switchable in each case independently from the other final rinse nozzle units 196, for example between an engaged state and a disengaged state. To this end, the fresh water final rinse zone nozzle system 178 can comprise, for example, a plurality of switching elements 208 which can be developed, for example, as valves 210. By means of said switching elements 208, in particular the valves 210, the final rinse nozzle units 196 can be switched independently of one another such that, for example controlled by the control means 194, the impingement regions 202 are able to be acted or not acted upon with final rinse fluid independently of one another by means of correspondingly switching the switching elements 208.

In this case, the exemplary embodiments in FIGS. 2 and 3 differ in that in the exemplary embodiment according to FIG. 2 each final rinse nozzle unit 196 includes precisely one final rinse nozzle 198 which is switchable by means of a corresponding switching element 208. In the exemplary embodiment according to FIG. 3, in contrast, several final rinse nozzles 198 are each combined to form groups which in each case form a switchable final rinse nozzle unit 196 which is switchable in each case by means of a switching element 208, for example a valve 210. Accordingly, in the case of the exemplary embodiment according to FIG. 3, each final rinse nozzle unit 196 includes a plurality of final rinse nozzles 198 arranged side by side in the direction x.

The characteristic of the optional development of the independent switchability of the final rinse nozzle units 196 arranged side by side consists in that the impingement with cleaning fluid 112 is able to be adapted corresponding to an occupancy of the conveying device 118. For example, the final rinse nozzle units 196 can be switched according to requirement, depending on an occupancy of the conveying device 118 at the site of the fresh water final rinse zone nozzle system 178. As shown in FIG. 1, one or several sensors 212 for the articles to be cleaned are provided in order to detect the loading. In the exemplary embodiment shown, the sensor 212 for the articles to be cleaned is provided at the inlet opening 128. As an alternative to this or in addition to it, said at least one sensor 212 for the articles to be cleaned can, however, also be arranged at other points inside or outside the cleaning apparatus 110, for example inside the cleaning chamber 122. For example, the sensor 212 for the articles to be cleaned can include a visual sensor, for example a camera system. An occupancy of the conveying device 118, for example a belt occupancy, can be recorded in this way. As, in principle, the conveying speed of the conveying device 118 is known, for example by means of a corresponding actuation and/or on account of corresponding signals in the control means 194, and also the spacing between the sensor 212 for the articles to be cleaned and the fresh water final rinse zone nozzle system 178 is known, it can be accordingly known at any moment in time which belt occupancy is present in the impingement regions 202 in the region of the fresh water final rinse zone nozzle system 178, even when the sensor 212 for the articles to be cleaned is arranged at a spacing from the fresh water final rinse zone 160 in the conveying direction 120. Accordingly, the control means 194 can be set up to engage just those final rinse nozzle units 196 which act upon an impingement region 202 with final rinse fluid, in which articles 112 to be cleaned are actually present. The remaining final rinse nozzle units 196 can be disengaged or remain disengaged by correspondingly switching the switching elements 208 such that no unnecessary spraying out of final rinse fluid is effected in said impingement regions 202. In this way, enormous quantities of final rinse fluid, in particular fresh water, can be saved, independently of the development chosen in each case, for example according to FIG. 2 or FIG. 3, as a result of disengaging, where required, the final rinse nozzle units 196.

In this respect the cleaning apparatus 110 can correspond, for example, to the cleaning apparatus disclosed in DE 10 2012 211 442 A1. However, other developments are also possible in principle.

Within the framework of the present invention, however, is it additionally proposed that the control means 194 detects a loading of the conveying device 118 with articles to be cleaned 112 by means of the sensor 212 for the articles to be cleaned and is set up to select at least one operating mode of the cleaning apparatus 110 corresponding to the detected loading and to propose the selected operating mode to a user of the cleaning apparatus 110. The operating mode, for example, can be a cleaning program, a conveying speed of the conveying device 118 or also, as stated below as an example, simply a partial occupancy of the conveying device 118 with articles to be cleaned.

Thus, the control means 194 can detect, for example, that on account of the current utilization of the cleaning apparatus 110, that is to say on account of the current occupancy of the cleaning apparatus 118 with articles to be cleaned 112, ordered occupancy of the conveying device 118 would be more sensible than a present random occupancy. Accordingly, the selected operating mode can, for example, consist in that simply part of the conveying device 118 is occupied with articles to be cleaned 112, for example a certain track 214. This is shown as an example in FIG. 4 which shows the region of the inlet 144 of the cleaning apparatus 110, in a top view onto the inlet opening 128.

It can be seen there that the sensor 212 for the articles to be cleaned detects the articles to be cleaned 112 on the conveying device 118. For example, the sensor 212 for the articles to be cleaned can record a number of articles to be cleaned 112 per unit time and/or per unit area, or also an overall number of articles to be cleaned 112. The control means 194 can detect, for example, that in the case of said occurrence of articles to be cleaned 112, occupancy of simply a certain track 214 would be more favorable such that, for example, simply the nozzle units with which said track 214 is associated have to be engaged, whereas other nozzle units are able to be disengaged. For example, these can be the final rinse nozzle units 196 and/or other nozzle units.

In place of implementing the selected operating mode directly and automatically without any activation by the user, the control means 194 initially proposes the selected operating mode to the user. For this purpose, the cleaning apparatus 110 includes a display device 216, which can include, for example, at least one display 218 or another type of display. For example, at least one display can be provided in the region of the inlet 144 such that the operating personnel can see the display in said region and the proposal shown thereon.

The cleaning apparatus 110 can include, for example, in particular at least one control element 220 which is actuatable by the user. Said control element 220 is also preferably arranged completely or in part in the region of the inlet 144 such that it can be operated there by the user. In the exemplary embodiment shown, the control element 220 can include, for example, a membrane key or a virtual control element on the display 218 of the display device 216. For example, the display 218 can include a touch screen, on which the control element 220 is arranged.

By means of the control element 220, the user can confirm the proposal of the control means 194 with regard to at least one selected operating mode which is shown and proposed by means of the display device 216. As an alternative to this, the user can also select, for example, between several proposed selected operating modes. Once again as an alternative to this, the user is also able, for example, to reject the proposal.

The cleaning device 110 can be developed in such a manner that the control means 194 only implements the selected operating mode once the user has confirmed said proposal. In this way, the user maintains control and dominance over the cleaning process.

Figure 4:
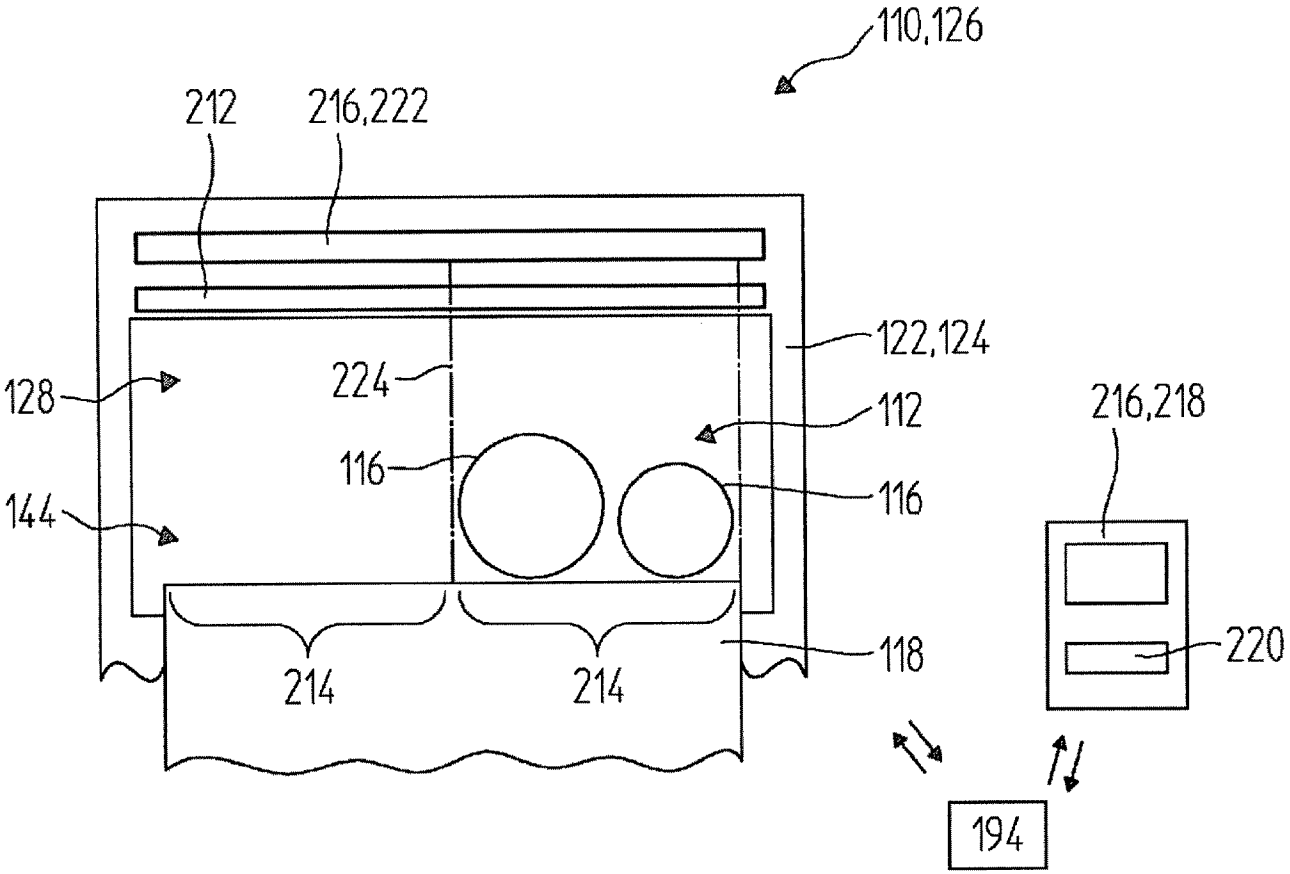
FIG. 4: shows a view of an inlet opening of the cleaning apparatus shown in FIG. 1.

The display device 216 can additionally include further devices in addition to or as an alternative to the display 218. Thus, the display device 216 can include, for example, as shown in FIG. 4, an illuminating device 222 which is set up to illuminate selectively one or several tracks 214 of the conveying device 118. The illuminating is marked symbolically in figure four by way of the reference numeral 224. Thus, for example, the track 214 selected within the framework of the proposal can be illuminated, whereas other portions of the conveying device 118 remain non-illuminated. Said illumination of the selected track 214 can already be effected within the framework of the proposal of the selected operating mode and/or cannot be implemented until the user confirms the proposed selected operating mode by means of the control element 220.

As a result of illuminating the selected track 214, an energetically more favorable operating mode which can be adapted to requirements can be implemented. Thus, as explained above, one or several of the nozzle systems 164 can be adapted to the selected operating mode. If, for example, the selected operating mode contains that just one or several selected tracks 214 are occupied with articles to be cleaned 112, just those nozzle units or the nozzle unit which is/are associated with said at least one selected track 214 can be activated for example, whereas other nozzle units are disengaged. As an example, as stated above, these can be the corresponding final rinse nozzle units 196. As an alternative to this or in addition to it, however, others of the nozzle systems 164 are also correspondingly switchable. The above-described techniques can be used for this purpose.

As a result of illuminating 224 the track 214 of the conveying device 118, the user, after confirming the proposal and after starting to implement the proposed operating mode, can then always recognize the track to be occupied of the conveying device 118, for example of the conveyor belt, and occupy it correspondingly with articles to be cleaned 112, whereas other portions of the conveying device 118 can remain free. Nevertheless, a safety function can be provided.

Thus, the control means 194 can be set up, for example, to detect an incorrect occupancy by means of the sensor 212 for the articles to be cleaned and then, when detecting an incorrect occupancy, to implement one or several corresponding measures. For example, nozzle units can be activated in the short-term in the event of incorrect occupancy, in order to ensure that even articles to be cleaned 112 that are incorrectly arranged at occupied positions of the conveying device that are not scheduled to be occupied can also be acted upon with cleaning fluid and cleaned in a normal manner. As an alternative to this or in addition to it, the control means 194 can be set up to output a warning to the user, for example by means of the display device 216. Thus, for example, a corresponding warning can be output on the display 218, and/or by means of the illuminating device 222 corresponding light signals can be output, for example in the form of a flashing light or in the form of a red warning light. Once again as an alternative to this or in addition to it, the control means, however, can be set up to stop the conveying by the conveying device 118 in the short-term in order to give the user the opportunity to correct the incorrect occupancy. Once again as an alternative to this or in addition to it, the control means 194 can also be set up to create a new proposal with regard to an adapted operating mode and to propose by means of the display device 216, for example by increasing a track width of the track 214, in order to emphasize, for example, an increased requirement. The named possibilities can be implemented independently of the type of the cleaning apparatus 110, that is to say, for example, also in exemplary embodiments other than the exemplary embodiment shown in FIGS. 1-4.

In place of the illumination 224 or in addition to said illumination, other forms of the display can also be provided. For example, as stated above, a traffic light system can be provided or a system with lighting arrows or crosses, analogous to a traffic control means in road traffic.

The above-described possible operating mode of an occupancy of one or several selected tracks 214 of the conveying device 118, however, provides a possibility of an operating mode by means of which the operation of the cleaning apparatus 110 can be adapted to the actual requirement. As an alternative to this or in addition to it, other possibilities are conceivable. For example, a conveying speed of the conveying device 118 can be adapted to requirements. Said proposal can also be confirmed, for example, by the user by means of the control element 220.

In place of an acknowledgment, developed as before, of the proposal of the control means 194 with regard to a selected operating mode, the user, for example once again by means of the control element 220, can also be put in a position to reject the proposal. This can be sensible, for example, whenever the user recognizes that in the near future more articles to be cleaned 112 will arrive, as the user knows, for example, an operating schedule or as the user, for example, sees dirty glasses 114 or plates 116 which are currently present but have not yet been brought into the cleaning apparatus 110, for example on a trolley.

The control means 194, in said exemplary embodiment or also in other exemplary embodiments, can be set up in different ways to submit the proposal of the selected operating mode. Thus, for example, a plurality of operating modes can be filed, for example a plurality of operating modes which, in each case, include one or several selected tracks 214 and associated switched nozzle units. Said operating modes can be filed, for example, in a data storage unit of the control means 194, for example as a table. Each of said filed operating modes can have associated therewith, for example, an emergence of articles to be cleaned 112. If the control means 194 detects by means of the sensor 212 for the articles to be cleaned that a certain emergence is currently present, the operating mode associated with said emergence is selected from the plurality of operating modes and is proposed.

As an alternative to or in addition to the implementation of an operating mode, shown in FIG. 4 as an example, by selecting at least one track 214 which is to be occupied with articles to be cleaned 112, it is also possible to include other operating parameters in the operating mode. Thus, for example, an operating mode can also include adaptation of the conveying speed of the conveying device 118 to the current emergence of articles to be cleaned 112. If, for example, it is ascertained that only a small emergence is present, it is possible to select an operating mode where a slower conveying speed is present. A flow of cleaning fluid into the nozzle system 164 can also be adapted correspondingly. Here too, the selection can also be made, for example, once again as a result of a plurality of operating modes being filed, in which, in each case, a certain emergence of articles to be cleaned 112 has associated therewith a conveying speed. Corresponding to the emergence currently recognized by means of the sensor 212 for the articles to be cleaned, the selection of a corresponding operating mode can then follow, which is then proposed to the user. In principle, in this case and in the case of the selection of one or several tracks 214, other possibilities are, however, also realizable, for example calculating optimum operating parameters.

The control means 194 can be set up in the described exemplary embodiment or also in other exemplary embodiments to check the operating mode currently implemented, for example continuously or at pre-determined or predeterminable intervals. The checking can be effected, for example, by means of the sensor 212 for articles to be cleaned giving consideration to the current emergence of articles to be cleaned 112. Accordingly, for example, when the necessity for a new adaptation is recognized, a new proposal for an adapted operating mode is submitted. The proposed method can therefore, for example, be carried out iteratively in order always to implement an operating mode which is adapted to requirements. The adapted operating mode, for example, once again, can also only be implemented once the user has confirmed it by means of the control element 220. It is therefore always ensured within the framework of the present invention that the user maintains dominance over the cleaning process, it being possible nevertheless to ensure the cleaning action.

LIST OF REFERENCES

110 Cleaning apparatus
112 Articles to be cleaned
114 Glasses
116 Plates
118 Conveying device
120 Conveying direction
122 Cleaning chamber
124 Cleaning tunnel
126 conveyor dishwashing machine
128 Inlet opening
130 Partition curtain
132 Cleaning zones
134 Partition curtain
136 Drying zone
138 Blower
140 Outlet

142 Conveying basket
144 Inlet
146 Wash zone
148 Pre-wash zone
150 Main wash zone
152 Pre-wash zone tank
154 Main wash zone tank
156 Final rinse zone
158 Pumped final rinse zone
160 Fresh water final rinse zone
162 Final rinse tank
164 Cleaning system, nozzle system
166 Pre-wash zone nozzle system
168 Pre-wash zone pump
170 Main wash zone nozzle system
172 Main wash zone pump
174 Pumped final rinse zone nozzle system
176 Pumped final rinse zone pump
178 Fresh water final rinse zone nozzle system
180 Fresh water inlet
182 Fresh water connection
184 Preparation device
186 Heat recovery device
188 Suction blower
190 Heat exchanger
192 Instantaneous water heater
194 Control means
196 Final rinse nozzle unit
198 Final rinse nozzles
200 Spray jet
202 Impingement region
204 Upper spray arm
206 Lower spray arm
208 Switching element
210 Valve
212 Sensor for articles to be cleaned
214 Track
216 Display device
218 Display
220 Control element
222 Illuminating device
224 Illumination

The invention claimed is:

1. A cleaning apparatus for cleaning articles to be cleaned comprising:

at least one cleaning chamber;

at least one conveying device configured to convey the articles to be cleaned in a conveying direction through the cleaning chamber, the at least one conveying device comprising a plurality of tracks arranged side by side;

at least one nozzle system configured to act upon the articles to be cleaned with at least one cleaning fluid;

at least one sensor configured to detect a loading of the conveying device with articles to be cleaned;

at least one control means programmed to select at least one operating mode of the cleaning apparatus corresponding to the loading of the conveying device detected by the sensor, and to propose the selected operating mode to a user of the cleaning apparatus by providing a visual indicator on one or several tracks of the conveying device.

2. The cleaning apparatus as claimed in claim 1, wherein the selected operating mode comprises at least one operating parameter selected from future occupancy of the conveying device with items to be cleaned; conveying speed of the conveying device; a cleaning program; activation of one or several nozzles of the nozzle system; or deactivation of one or several nozzles of the nozzle system.

3. The cleaning apparatus as claimed in claim 2, wherein the future occupancy of the conveying device with items to be cleaned comprises utilization of the one or several predefined tracks of the conveying device.

4. The cleaning apparatus as claimed in claim 1, wherein the control means is further programmed to await confirmation of the proposed selected operating mode by the user and to not implement the proposed operating mode until receipt of confirmation by the user.

5. The cleaning apparatus as claimed in claim 1, further comprising at least one control element which is operable by the user, wherein the control means is further programmed to await confirmation of the proposed selected operating mode by the user via the control element and to not implement the proposed operating mode until receipt of confirmation by the user.

6. The cleaning apparatus as claimed in claim 1, further comprising at least one illuminating device, wherein the illuminating device is configured to select one or several tracks of the conveying device from an overall number of the plurality of tracks and to selectively illuminate the one or several tracks to provide the visual indicator thereon and to mark the one or several tracks for occupancy with articles to be cleaned.

7. The cleaning apparatus as claimed in claim 1, wherein the at least one sensor comprises an electric sensor; a capacitive sensor; an inductive sensor; an electro mechanical sensor; a mechanical sensor; an infrared sensor; an ultrasound sensor; an optical sensor; or an imaging sensor.

8. The cleaning apparatus as claimed in claim 1, wherein the nozzle system comprises at least one switchable nozzle system, wherein the switchable nozzle system comprises at least two nozzle units which are arranged at different positions transversely with respect to the conveying direction, and wherein the nozzle units are switchable independently of one another in order to act upon the articles to be cleaned with cleaning fluid at different positions independently of one another.

9. The cleaning apparatus as claimed in claim 8, wherein the selected operating mode includes at least one switching state of the switchable nozzle system.

10. The cleaning apparatus as claimed in claim 8, wherein the switchable nozzle system comprises at last one rinse nozzle system configured to act upon the articles to be cleaned with at least one rinse fluid, wherein the rinse nozzle system comprises at least two rinse nozzle units which are arranged at different positions transversely to the conveying direction, and wherein the rinse nozzle units are switchable independently of one another in order to act upon the articles to be cleaned with the rinse fluid at different positions independently of one another.

11. The cleaning apparatus as claimed in claim 10, wherein the rinse fluid comprises fresh water.

12. The cleaning apparatus as claimed in claim 8, further comprising an associated switching element connected upstream of each nozzle unit, wherein the associated switching element is switchable to connect, via the associated switching element, the acting upon the articles to be cleaned via the nozzle unit.

13. The cleaning apparatus as claimed in claim 8, wherein the control means is further programmed to:

switch the nozzle units, deduce an expected future loading from a current loading of the conveying device with articles to be cleaned, propose to the user via a display device, on a basis of an expected future loading, occupancy of one or of several selected tracks of the conveying device with articles to be cleaned, leaving the remaining conveying device free; and connect the nozzle units corresponding to the one or several selected tracks such that the one or several selected tracks are acted upon with cleaning fluid.

14. The cleaning apparatus as claimed in claim 13, wherein the control means is further programmed to detect, via the sensor, non-selected tracks which have been incorrectly occupied with articles to be cleaned and to switch the nozzle units such that the non-selected tracks which have been incorrectly occupied with articles to be cleaned are acted upon with cleaning fluid in a short term.

15. A method for cleaning articles to be cleaned with the cleaning apparatus as claimed in claim 1, the method comprising:

conveying the articles to be cleaned via the at least one conveying device through at least one cleaning chamber of the cleaning apparatus;

acting upon the articles to be cleaned via the at least one nozzle system with the at least one cleaning fluid;

detecting a loading of the conveying device with articles to be cleaned via the at least one sensor;

selecting at least one operating mode of the cleaning apparatus corresponding to the loading of the conveying device with the articles to be cleaned; and proposing the selected operating mode to a user of the cleaning apparatus by providing a visual indicator on one or several tracks of the conveying device.

16. The cleaning apparatus as claimed in claim 1, wherein the cleaning apparatus comprises a conveyor dishwashing machine.

17. The cleaning apparatus as claimed in claim 1, wherein a division of the at least one conveying device into plurality of tracks arranged side by side is a virtual division.

18. The cleaning apparatus as claimed in claim 1, wherein a division of the at least one conveying device into plurality of tracks arranged side by side is variable.

19. The cleaning apparatus as claimed in claim 1, further comprising a display device configured to communicate the proposed selected operating mode to the user.

20. A cleaning apparatus for cleaning articles to be cleaned comprising:

at least one cleaning chamber;

at least one conveyor configured to convey the articles to be cleaned in a conveying direction through the cleaning chamber, the at least one conveyor comprising a plurality of tracks arranged side by side;

at least one sensor configured to detect a loading of the conveyor with the articles to be cleaned;

at least one controller programmed to select at least one operating mode of the cleaning apparatus corresponding to the loading of the conveyor detected by the sensor, and to propose a selected operating mode to a user of the cleaning apparatus by providing a visual indicator on one or several tracks of the conveyor.

* * * * *